US011815336B2

(12) United States Patent
Böhringer et al.

(10) Patent No.: US 11,815,336 B2
(45) Date of Patent: Nov. 14, 2023

(54) PROTECTIVE CLOTHING UNIT AND USE THEREOF

(71) Applicant: Blücher GmbH, Erkrath (DE)

(72) Inventors: Bertram Böhringer, Erkrath (DE); Hasso Von Blücher, Erkrath (DE); Katrin Freier, Erkrath (DE)

(73) Assignee: BLÜCHER GMBH

( * ) Notice: Subject to any disclaimer, the term of this patent is extended or adjusted under 35 U.S.C. 154(b) by 143 days.

(21) Appl. No.: 16/473,181

(22) PCT Filed: Sep. 14, 2017

(86) PCT No.: PCT/EP2017/073184
§ 371 (c)(1),
(2) Date: Jun. 24, 2019

(87) PCT Pub. No.: WO2018/114069
PCT Pub. Date: Jun. 28, 2018

(65) Prior Publication Data

US 2019/0323800 A1 Oct. 24, 2019

(30) Foreign Application Priority Data

Dec. 23, 2016 (DE) ..... 10 2016 015 416.0
Feb. 22, 2017 (DE) ..... 10 2017 103 584.2

(51) Int. Cl.
*F41H 1/02* (2006.01)
*A41D 31/30* (2019.01)
*A41F 1/00* (2006.01)

(52) U.S. Cl.
CPC ..... *F41H 1/02* (2013.01); *A41D 31/30* (2019.02); *A41F 1/00* (2013.01)

(58) Field of Classification Search
CPC ... F41H 1/02; A41F 1/00; A41F 1/008; A41D 2300/30; A41D 2400/44; A41D 2400/70
USPC ..... 2/2.5
See application file for complete search history.

(56) References Cited

U.S. PATENT DOCUMENTS 715,516 A * 12/1902 Sessions ..... A41F 1/00 2/218
3,426,397 A * 2/1969 Redden ..... A41F 1/00 24/580.1
3,698,045 A * 10/1972 Redden ..... E04H 15/64 24/580.1
5,632,071 A * 5/1997 Maunder ..... A41F 1/00 24/580.1
2009/0282595 A1* 11/2009 Branson ..... F41H 1/02 2/2.5
2011/0191933 A1* 8/2011 Gregory ..... A41D 13/0012 2/69

(Continued)

FOREIGN PATENT DOCUMENTS

DE 102014110623 1/2016
WO WO-2016113548 A1 * 7/2016 ..... F41H 1/02

*Primary Examiner* — Aiyang Zhao
(74) *Attorney, Agent, or Firm* — Edward E. Sowers; Brannon Sowers & Cracraft PC

(57) ABSTRACT

The invention relates to a protective clothing unit, in particular a textile protective clothing unit, preferably a protective clothing unit having protection against splinters and/or fragments and/or having a ballistic protective function. The invention further relates to a use of said protective clothing unit.

22 Claims, 5 Drawing Sheets

(56) References Cited

U.S. PATENT DOCUMENTS

| | | | | |
|---|---|---|---|---|
| 2014/0099159 | A1* | 4/2014 | Maunder | A63H 33/105 403/294 |
| 2014/0260939 | A1 | 9/2014 | Neal | |
| 2014/0331375 | A1* | 11/2014 | Howland | F41H 1/02 2/2.5 |
| 2015/0237922 | A1* | 8/2015 | Gill | A41D 1/04 2/102 |
| 2017/0227331 | A1* | 8/2017 | Hexels | A41D 13/0007 |

* cited by examiner

PROTECTIVE CLOTHING UNIT AND USE THEREOF

CROSS-REFERENCES TO RELATED APPLICATIONS

This application is a National Stage filing of International Application PCT/EP 2017/073184, filed Sep. 14, 2017, entitled PROTECTIVE CLOTHING UNIT AND USE THEREOF, claiming priority to DE 10 2016 015 416.0, filed Dec. 23, 2016, and to DE 10 2017 103 584.2, filed Feb. 22, 2017. The subject application claims priority to PCT/EP 2017/073184, to DE 10 2016 015 416.0, to DE 10 2017 103 584.2, and incorporates all by reference herein, in their entirety.

BACKGROUND OF THE INVENTION

The present invention relates to the technical field of protection clothing units, or of items of protection clothing, respectively, which are conceived in particular for military use and which in particular have a protection function in relation to ballistic objects or projectiles, respectively, in particular in the form of splinters, fragments or the like, and thus have corresponding splinter protection or a respective ballistic protection function, respectively.

The present invention relates in particular to a protection clothing unit, in particular to a textile protection clothing unit, preferably to a protection clothing unit having splinter or fragment protection, respectively, or having a ballistic protection function, respectively, wherein the protection clothing unit according to the invention has or is composed of, respectively, at least one, in particular textile, protection clothing piece, wherein the protection clothing piece is likewise equipped with a protection function in relation to splinters or fragments, respectively, which are caused or released, respectively, by detonation or explosion, respectively. The protection clothing unit according to the invention, which hereunder will be defined in more detail, is in particular distinguished in that the underlying protection clothing piece does at least not substantially release or configure, respectively, any secondary splinters or secondary fragments, respectively, and/or in that the protection clothing piece being discussed is expediently provided with at least one separating or opening installation, respectively, which enables any in particular emergency-related or accelerated, respectively, undressing of the wearer.

In this context, the present invention also relates to the use of the protection clothing unit according to the invention, said use being defined hereunder.

The present invention moreover also relates to a separating or opening installation, respectively, per se, as is defined hereunder.

Persons deployed in the defense sector as well as in the sector of terrorism countermeasures, such as soldiers of military units, border control agents, police officers, security personnel, or the like, in the context of the deployment thereof, such as military combat missions or security missions, anti-terrorism missions, or missions for countering in particular military or terrorism actions, are often confronted with an acute or at least latent risk of direct physical action such as is caused, for example, by the action or explosion, respectively, of blasting devices, besides the use of firearms or stabbing weapons. In this context, blasting devices which release splinters and which can lead to often life-threatening as well as multiple injuries in persons exposed to an explosion of this type are to be mentioned in particular. The affected persons can in particular be persons or soldiers, respectively, who are deployed in the military combat or security mission, respectively, or in the sector of terrorism countermeasures, respectively and who serve for example internationally in regions of crisis or unrest, respectively.

An acute threat to persons or soldiers, respectively, deployed in this context is to be seen in so-called non-conventional blasting devices which synonymously are also referred to as IEDs (improvised explosive devices). Blasting devices of this type have progressed to being a subtle tool with a high injury or risk potential, respectively, when confronting or waging war against, respectively, the aforementioned groups of persons, in particular soldiers.

Non-conventional blasting devices are also associated with a high risk potential in that said non-conventional blasting devices can often be produced without any major technical complexity and in this context can also vary in terms of the material, size and appearance, this rendering said non-conventional blasting devices difficult to pinpoint and identify. Moreover, non-conventional blasting devices often develop a high destructive force, associated with a correspondingly high risk of injury, in particular as a result of the explosive release of primary and secondary splinters or fragments, respectively, and of the creation of a large shockwave, on the one hand, and of fire and heat, on the other hand.

The functional mode of non-conventional blasting devices generally lies in that the blasting device is brought to burst by igniting explosive substances, this being associated with the explosive release of primary splinters or fragments, respectively, which proceeding from the location of the explosion, conjointly with the shockwave being simultaneously created, propagate at high speed. Moreover, the shockwave and the primary particles creating can lead to the subsequent release of secondary splinters or fragments, respectively, specifically often in the form of (minute) particles such as dirt, dust, and sand, as well as fragments of destroyed objects from the direct or indirect, respectively, environment of the location of the explosion of the blasting device. The secondary splinters herein can also emanate, for example, from items of equipment, vehicles (such as the vehicle interior), destroyed by the explosion, or else from an item of protection clothing per se. The splinters arising herein can penetrate the upper skin layers of the affected person and herein also ingress deeply into the body, this being also associated with the destruction of, or injury to, respectively, physiologically important body structures such as, for example, blood vessels, nerve tracts, organs, or the like.

By virtue of the functional mode of non-conventional blasting devices, having the explosive release of splinters or splinter projectiles, respectively, severe injuries over a large area can often occur in the case of persons exposed to explosions of this type, said injuries resulting in particular due to the penetration of primary and secondary splinters or fragments, respectively, into the body, or else due to the (explosion) shockwave, or the influence of fire and heat, respectively.

Secondary splinters or secondary fragments, respectively, are in particular created in that primary splinters or fragments, respectively, that in the context of the detonation are released by the blasting device per se at the location of the explosion hit further objects, including also protection equipment, wherein (secondary) splinters or (secondary) fragments, respectively, which result from the object per se on account of the high-impact energy are released. Splinters or fragments, respectively, of this type can also lead to correspondingly severe injuries, the more so since said splinters or fragments, respectively, generally can have a sharp-edged shape, such that a penetration of the body with the associated injuries can be caused in the case of a corresponding acceleration.

In this context, the secondary splinters or fragments, respectively, being discussed can also emanate or be released from, respectively, the equipment of a soldier or the like in general, as well as the protection equipment in particular, as has been stated above, such that consequently a not insignificant risk in the case of a detonation also emanates from the equipment or the clothing, respectively, of a soldier per se, for example. Since on account of the effective forces of an underlying explosion, the protection clothing unit per se, or respective clothing elements, respectively, can also be destroyed while configuring secondary splinters or fragments, respectively, in particular wherein the underlying clothing or protection equipment, respectively, can be destroyed, fragmented, or released, respectively, by the effect of the explosion, and the splinters or fragments, respectively, released herein can be accelerated.

In this context, inflexible, semi-firm, and firm elements or component parts, respectively, such as buttons, zip fasteners, buckles, or the like, of a personal item of protection equipment represent an additional risk factor for example since said elements or component parts, respectively, by the in particular physical forces released in the case of an explosion, in particular an IED explosion, can likewise be released, destroyed or fragmented, respectively, and accelerated in a corresponding manner such that said elements or component parts, respectively, configure or represent, respectively, additional secondary splinters or fragments, respectively, which in turn can act as ballistic bodies and can penetrate the human body, as has been stated above, this potentially causing severe wounds or injuries, respectively, or potentially further deteriorating already present injuries, respectively.

The penetration of an affected person by secondary splinters or fragments, respectively, is moreover generally associated with an increased risk of infection, the more so since contaminated secondary splinters in the case of an increased splinter density hit the body in high numbers and at a minor mutual spacing (that is to say with a high splinter density), and often ingress the skin or the tissue, respectively, to great depth. Primary splinters can also lead to comparable consequences.

As a result, it is thus to be established that one of the main risk factors to which persons or soldiers, respectively, deployed in the military combat or securing mission, respectively, or in the sector of terrorism countermeasures, respectively, are exposed in particular in international regions of crisis is to be seen in the effects of IED explosions, the more so since in this context, as has been stated above, in the case of an explosion a shockwave as well as subsequent secondary splinters or fragments, respectively, are developed or released, respectively, specifically also proceeding from equipment or protection materials, respectively, and protection suits, wherein the splinters or fragments, respectively, propagate at maximum speed and often can lead to multiple injuries to the human body, which in turn leads to severe direct effects and pronounced long-term consequences for the affected person.

In this context, injuries to the following body regions or areas, respectively, often result in the case of persons who are confronted by an explosion of non-conventional blasting devices (even when the persons in question wear a ballistic protection vest for the chest region or the upper body region, respectively), wherein the injuries can be severe and life-threatening and can also be caused or worsened, respectively, by secondary splinters or fragments, respectively which emanate from the equipment or protection material per se: (i) lower extremities; (ii) genitals as well as internal sexual organs; (iii) bladder and urinal tract (urogenital tract); (iv) perineal and anal region; (v) lower abdomen with intestine, kidneys, spleen, and liver; (vi) in particular the lateral torso with parts of the lung lobes; (vii) rear torso in the renal pelvis region and the spine; (viii) upper extremities and shoulder region; and (ix) neck and lower facial part. Moreover, in some instances severe injuries to the artery and vein system, in particular close to the surface, and to the skin surface also result generally, in particular on account of the penetration of splinters and the effect of heat in the aforementioned body portions.

In this context, injuries by penetration to such body regions or areas in which the blood vessel system (aorta and vein system) runs relatively closely below the skin surface, since a particularly high risk of injury to blood-conducting vessels with a correspondingly high loss of blood occurs in these regions and is associated with the risk of bleeding to death, or of hypertension, are generally also problematic. These regions include in particular the genital region and the region of the thighs as well as of the knees, or the popliteal fossa. The regions particularly sensitive to injuries moreover also include the inner thighs with the adjacent perineal and anal region, the region of the spine, the lower stomach region, the neck region with the carotid arteries running therein, the shoulders, and the arms with the elbows or the antecubital area and with the region of the wrists as well as in particular the lower facial part.

The region of the abdominal cavity with the stomach/intestinal tract as well as the urinal tract is also extremely problematic in terms of a penetration by splinters, since the organs or organ portions in question are at least partially filled with liquids which can comprise infectious bacteria such that any injury in these regions with a corresponding release of liquid can lead to severe systemic infections. With reference to the inner organs, in particular in the region of the abdominal cavity, it is also to be mentioned that said inner organs by virtue of being filled with liquid (for example the urinary bladder) absorb the kinetic energy associated with the impact of splinters and can burst on account thereof.

Moreover, the injuries caused often require severe surgical intervention, including the amputation of extremities or of the genitals, respectively. In this instance, a sustained loss of mobility, or a sustained restriction in terms of the quality of life of the affected persons often arises.

The explanations above overall show that there is a large requirement in the prior art for providing an effective protection system in the form of clothing items with a protective effect in relation to splinters released by explosion or detonation, respectively, said protection systems, while providing positive manageability and positive wear comfort, guaranteeing a protection function over a large area which is also adaptable individually, or in terms of the underlying risk situation (that is to say both in terms of the size and the number of the body regions to be protected, as well as in terms of the configuration of the protection level for the respective body regions to be protected), wherein a system of this type should also be suitable to be worn permanently and for providing a durable or long-term, respectively, protection function, and wherein no subsequent risk should emanate from the protection system per se, in particular with a view to avoiding the configuration of secondary splinters or fragments, respectively.

In this context, there is thus also a large requirement in the prior art for such protection systems in the form of clothing items in which the formation of likewise highly problematic secondary splinters or fragments, respectively, which are released from the protection system or the clothing, respectively, per se under the influence of an explosion, or under a ballistic influence, is minimized or prevented, respectively. However, systems of this type are not yet known in the prior art. Rather, the prior art significantly focuses on the provision of such devices having a ballistic protection function, which are not especially focused on splinter protection, on the one hand, and which are capable of protecting only individual body regions or portions, respectively, per se in a certain manner on the other hand, as is the case, for example, in protection vests or helmets, wherein devices of this type often have component parts or components, respectively, which can lead to the configuration of the secondary splinters or fragments, respectively, in question, and moreover often do not offer an optimal wear comfort, the latter overall reducing the wear acceptance and thus the wear duration.

Moreover, the protection devices known in the prior art often have the problem that said protection devices, for example in the case of injury, or for the purpose of medical emergency treatment, respectively, cannot be rapidly removed from the body of a wearer, or be removed only with great complexity, respectively, so that the undressing or removal of clothing, respectively, is often time-intensive and is associated with further unnecessary stress for the wearer.

However, in the case of the protection systems known in the prior art, by virtue of the respective material properties, there is the problem that said protection systems in particular also have a high resistance to cutting, which renders the emergency-related cutting of the clothing difficult or impossible, respectively, such that the affected wearer of the protection system has to be undressed in a complex manner, which in turn can be associated with a worsening of underlying injuries. The protection systems known in the prior art generally thus do not permit any rapid removal while avoiding excessive body movements of the affected wearer, such that a simple release of the clothing, or releasing an injured person from the clothing, respectively, is often not possible. This is in particular also disadvantageous from the point of view that the victim, in particular also in the case of an IED explosion, has to be provided with on-the-scene medical care as fast as possible, wherein the protection system, or the protection clothing, respectively, to this end generally should be completely and immediately removed from the body of the wearer.

There is consequently a further requirement in the prior art for such protection systems in the form of clothing items which, in particular in the case of an injury to the wearer of the protection system and thus in particular in the case of a medical emergency, can be rapidly removed and without great complexity from the body of the wearer so as to be able to carry out respective on-the-scene care measures, or medical (emergency) measures.

Moreover, the materials used in the prior art for providing the protection devices do not always have a desired durability in terms of the ballistic stability. Moreover, the haptic properties are not always optimal.

In the prior art it is in particular not yet provided to make available protection devices or respective protection clothing, respectively, which have an overall high splinter or fragment protection, respectively, both in relation to primary splinters or fragments, respectively, as well as in relation to secondary splinters or fragments, respectively, wherein no further measures have moreover been pursued in the prior art to date to minimize or to prevent, respectively, the release of secondary splinters or fragments, respectively, from the protection device or the protection clothing, respectively, per se, and to improve the manageability of the clothing in emergency situations, in particular in as far as the possibility of rapid undressing is concerned.

DE 30 34 547 C2 relates to a clothing piece having at least one anti-penetration planar element from a plurality of three-dimensionally shaped and conjointly solidified tiers from textile aramid fiber areas, wherein the planar element by quilting is solidified in a pre-chosen shape that is adapted to the body shape of the wearer. By virtue of the solidification of the underlying material provided, the release of secondary splinters or fragments, respectively, from the material per se can arise in some instances. Moreover, the wear comfort provided in this context is in some instances likewise not optimal.

WO 99/37969 A1, as well as DE 198 02 242 A1 and EP 1 058 808 A1 and U.S. Pat. No. 6,656,570 B1, the three latter being part of the same family of patents, furthermore relates to protection clothing for protection against stab injuries, said protection clothing intended to guarantee a certain level of protection in relation to needle-type stab apparatuses, wherein the protection clothing is composed of a plurality of tiers of planar structures from break-proof materials, wherein more than one of the tiers is coated with a hard-material layer. By virtue of the mandatorily provided hard-material layer, the adaptability and the wear comfort are in some instances minimized. Moreover, the configuration of secondary splinters or fragments, respectively, can also arise in the case of the underlying material.

Overall, there is thus a large requirement for special protection clothing systems to be provided which at a simultaneously high protection function in relation to splinters released by detonation or explosion also have a high wear comfort, and in the case of which a protection function which is individually adaptable or adaptive, respectively, in particular with a view to the underlying risk situation, is possible for an individual multiplicity of body regions or areas, respectively, of a wearer, wherein moreover, in the case of an IED explosion or a ballistic effect, respectively, any risk or risk of injury to the wearer, respectively, emanating from the protection clothing system per se is to be minimized, and wherein overall also simplified and more rapid undressing, or removal, of the protection clothing system from the wearer, respectively, for example in the case of injury, in particular for the purpose of carrying out timely emergency measures or medical on-the-scene care, respectively, is to be guaranteed.

BRIEF SUMMARY OF THE INVENTION

Against this background, the present invention is therefore based on the object of providing an efficient concept for providing a protection clothing unit or respective protection clothing, respectively, wherein the disadvantages of the prior art outlined above are at least to be largely avoided or else at least mitigated.

An object of the present invention is in particular to be seen in providing a protection clothing unit which, in comparison to the prior art, has an improved protection function in relation to an in particular explosion-based action of splinters or fragments, respectively, wherein in this context the risk to a wearer of the protection clothing unit that emanates from the protection clothing unit per se is also to be minimized.

A further object of the present invention moreover lies in providing a respective protection clothing unit which in relation to protection systems of the prior art enables more rapid and simplified undressing, or removal of the protection clothing unit from a wearer of the protection clothing, respectively, in particular so as to on account thereof enable timely medical on-the-scene care in particular in the case of an injury, wherein the protection function per se provided by way of the protection clothing unit, as well as the wear properties, are at least not to be substantially influenced by the measures that enable the more rapid undressing.

In turn, a further object of the present invention likewise lies in providing a corresponding protection clothing unit which at a simultaneously high protective effect in relation to primary splinters or fragments, respectively, released by explosion or detonation, respectively, also is to have a further protection function in relation to corresponding secondary splinters or fragments, respectively, wherein the protection clothing unit provided according to the invention is simultaneously to have a high wear comfort and a high resistance also in relation to humidity and UV radiation, in association with maintaining the protection function even over comparatively long periods.

A yet further object of the present invention moreover lies in providing a corresponding protection clothing unit in which the splinter protection provided can be adapted individually, or specifically to the mission or situation, respectively with a view to body regions or portions, respectively, that are to be especially protected, wherein such a protection clothing unit which in terms of the protection function thereof can be individually configured is also to be provided according to the invention.

In order for the object set forth above to be achieved, the present invention, according to a first aspect of the present invention, thus proposes a protection clothing unit, in particular a textile protection clothing unit, preferably a protection clothing unit having splinter or fragment protection, respectively, or having a ballistic protection function, respectively, preferably having a protection function in relation to splinters or fragments, respectively, that are caused or released, respectively, by detonation or explosion, respectively, wherein the protection clothing unit has or is composed of at least one, in particular textile, protection clothing piece, preferably having a protection function in relation to splinters or fragments, respectively, that are caused or released, respectively, by detonation or explosion, respectively, as described herein; respective advantageous refinements and design embodiments of this aspect of the invention are the subject matter relating to the protection clothing unit according to the invention.

A further subject matter of the present invention, according to a second aspect of the present invention, is moreover the use of a protection clothing unit, in particular textile protection clothing unit, according to the invention, as provided herein relating to the use according to the invention.

A further subject matter of the present invention, according to a third aspect of the present invention, is finally also the separating or opening installation, respectively, per se according to the invention, as described herein; respective further advantageous refinements and design embodiments of this aspect of the invention are the subject matter as provided relating to the separating or opening installation, respectively, according to the invention.

It will be apparent that, in the description of the present invention which follows, such configurations, embodiments, advantages, examples or the like which—for the purpose of avoidance of unnecessary repetitions—are set out hereinafter only for an individual aspect of the invention are of course also correspondingly applicable in relation to the other aspects of the invention without requiring any explicit mention.

It will further be apparent that, in statements of values, numbers and ranges hereinafter, the stated values, numbers and ranges in this regard are not to be understood in a restrictive manner; it will be automatically apparent to the person skilled in the art that, depending on the individual case or based on the application, it is possible to depart from the ranges or figures given without having left the scope of the present invention. Moreover, it is applicable that all the values or parameters or the like that are stated hereinafter can in principle be ascertained or determined by normalized or standardized or explicitly specified determination methods or else, otherwise, by methods of determination or measurement that are familiar per se to the person skilled in the art in this field. Unless stated otherwise, the underlying values or parameters are ascertained under standard conditions (i.e., in particular, at a temperature of 20° C. and/or at a pressure of 1013.25 hPa or 1.01325 bar).

Otherwise, for all the statements of amount in relative or percentage terms that are given hereinafter, especially based on weight, it should be noted that these figures, in the context of the present invention, should be selected or combined by the person skilled in the art so as to result in the sum total—if appropriate taking into account of further components or ingredients, especially as defined hereinafter—always of 100% or 100% by weight. However, this will be automatically apparent to the person skilled in the art.

Having said that, the present invention is described and elucidated in detail hereinafter, specifically also with reference to drawings or figure representations that represent preferred embodiments and working examples.

In connection with the explanation of these preferred embodiments and working examples of the present invention, although these are in no way restrictive in relation to the present invention, further advantages, properties, aspects and features of the present invention are also indicated.

BRIEF DESCRIPTION OF THE DRAWINGS

FIG. 3 also highlights a preferred arrangement of the connection or receptacle elements, respectively, along the respective separating or opening installation, respectively, according to which the connection or receptacle elements, respectively, are specifically disposed so as to be mutually offset and mutually spaced apart such that corresponding connection or receptacle elements, respectively, of the one side of the separating or opening installation, respectively, in the closed state can be received in respectively corresponding gaps between corresponding connection or receptacle elements, respectively, of the other side;

DETAILED DESCRIPTION OF THE INVENTION

Figure 1:
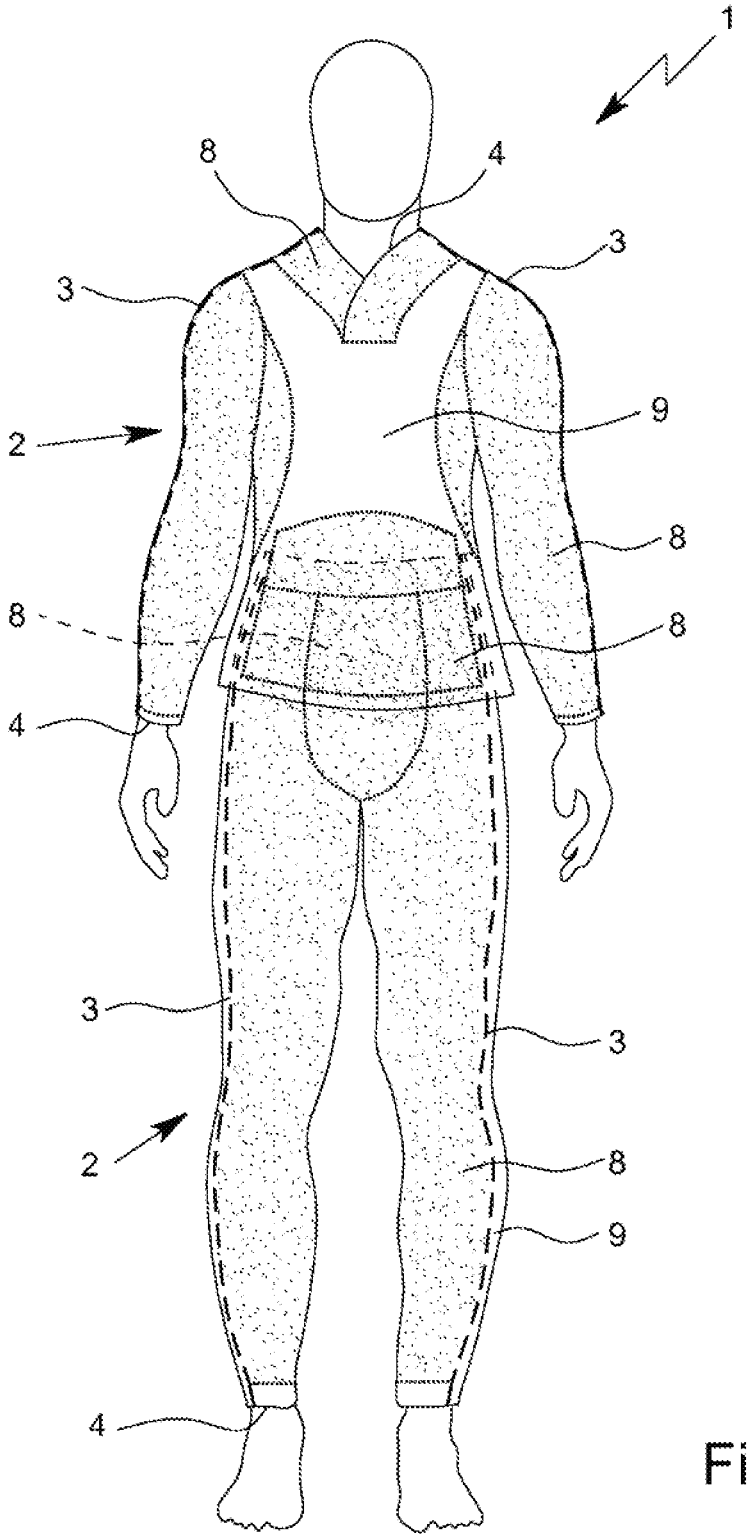
FIG. 1 shows a schematic illustration of a plan view of the front side of a protection clothing unit according to the invention, which two protection clothing pieces in the form of long-legged underpants integrated separating or opening installations, respectively, and onward running splinter protection planar elements, on the one hand, and in the form of a long-sleeve undershirt having likewise integrated separating or opening installations, respectively, and onward running splinter protection planar elements, on the other hand, wherein the illustrated protection clothing unit according to the invention does at least not substantially have any components or component parts, respectively, which release secondary splinters or secondary fragments, respectively.

The applicant in an entirely surprising manner has now established that in terms of protection clothing, in particular protection clothing for military deployment, or for military deployment, or for the deployment in the field of terrorism countermeasures or the like, a further improvement of the protection function in relation to splinters or fragments, respectively, released by detonation or explosion, respectively, such as are explosively released or caused, respectively, in the explosion of non-conventional blasting devices, for example, and an improvement of the handling with a view to rapid removal of the protection clothing unit in the case of an injury to the wearer, are guaranteed in that the protection clothing unit per se provided according to the invention does at least not substantially release any secondary splinters or secondary fragments, respectively, under the influence of detonation or explosion, respectively, and in that the protection clothing piece according to the invention moreover is equipped with a special separating or opening installation, respectively, which expediently enables emergency-related or accelerated undressing of a wearer of the protection clothing piece, wherein the separating or opening installation, respectively, is conceived in such a manner that also no secondary splinters or secondary fragments, respectively, are at least substantially released on account thereof, in particular under the influence of a detonation or explosion, respectively.

In other words, the present invention is significantly directed toward the protection clothing unit provided according to the invention, in particular under the influence of an explosion or detonation, respectively, and/or while hit by primary splinters or primary fragments, respectively, emanating from a detonation or explosion, respectively, or secondary splinters or secondary fragments, respectively, caused thereby, respectively, does at least not substantially release or configure any secondary splinters or secondary fragments, respectively, that emanate from the protection clothing per se and that in particular lead to injuries or worsen existing injuries, respectively, wherein according to the invention improved manageability in particular with a view to rapid undressing, or removal of the protection clothing, respectively, in particular in the context of an emergency situation, is simultaneously provided, since the coating on account of the targeted use of a separating or opening installation, respectively, in particular in the manner of a rapid or emergency opening, respectively, can be opened or separated, respectively, in defined regions.

The protection clothing according to the invention, also with a view to providing the protection function as well as to facilitated undressing, can moreover be individually adapted or configured, respectively, for example in the manner of full-body protection or with a view to further protection of specific body regions, wherein the corresponding protection function can be adapted or set, respectively, so as to depend on the situation, or with a view to the underlying mission or specific application, respectively, as will still be set forth hereunder. The protection clothing unit according to the invention herein also significantly guarantees effective ballistic protection in relation to primary or secondary splinters or fragments, respectively, which are released from the explosion or detonation, respectively, in particular of non-conventional blasting devices, as well as from the environment affected by the detonation. Moreover, there is also a protection function in relation to a shockwave emanating from the detonation or explosion, respectively, the effects of said shockwave on the wearer being able to be further minimized.

Based on the concept of the invention, it is in particular prevented that component parts or elements, respectively, of the protection clothing unit according to the invention, or of the underlying protection clothing piece, respectively, are released, destroyed, fragmented, accelerated, or the like on account of the effective forces which are linked with the detonation or explosion, respectively, such that the creation and penetration of secondary splinters or fragments, respectively, emanating from the protection clothing per se is effectively prevented or minimized, respectively, based on the protection clothing unit according to the invention.

Based on the concept according to the invention, overall the injury pattern resulting from the detonation or explosion, respectively, in particular of non-conventional blasting devices, is thus mitigated, wherein direct effects and long-term consequences for the wearer of the protection clothing unit according to the invention are moreover reduced. Based on the protection clothing unit according to the invention, an improved protection function in relation to stabbing, cutting, shooting, and/or shock is also moreover simultaneously provided.

It has also been a success here in the context of the present invention that the correspondingly provided protection functions are not negatively influenced on account of the purpose-related use of a special separating or opening installation which enables targeted undressing, since according to the concept according to the invention, no secondary splinters or fragments, respectively, are likewise at least substantially released by the separating or opening installation, respectively, and the stability of the protection clothing unit according to the invention is moreover not compromised in the worn state.

The term "splinter and/or fragment protection" such as is used according to the invention, herein is to be understood in a very broad manner and in particular relates to the general provision of a protection function in relation to the penetration or the ingress, respectively, of ballistic projectiles that are directly or indirectly released by detonation or explosion, respectively, in particular in the form of splinters or fragments, respectively, which are in particular distinguished by small particle sizes and by an irregular shape, and which in the form of primary and/or secondary splinters or fragments, respectively, are in particular explosively released in the detonation of non-conventional blasting devices and hit a person exposed to the detonation at a high speed or with kinetic energy, respectively, wherein the splinter or fragment protection also relates to splinters or fragments, respectively, emanating from the protection coating per se, wherein a further improvement of the protection function correspondingly is guaranteed by avoiding the creation of secondary splinters or fragments, respectively, which emanate from the protection clothing unit per se and are caused under the influence of detonation or explosion, respectively as explained above.

The protection performance provided according to the invention is thus provided by the purpose-related combination of the technical measures implemented according to the invention for the protection clothing unit according to the invention. Moreover, the materials that can be used according to the invention for the configuration of the protection clothing unit as well as respective blanks also lead to a further optimization of the protection characteristic, wherein the protection clothing unit can in particular be designed in such a manner that relevant body regions or portions, respectively, having a vitally high relevance can be in particular covered by way of an exact fit.

A core particularity of the protection clothing unit according to the invention herein is to be seen in that, by virtue of the special design embodiment and construction, in particular based on the components and materials being used, as well as of the implementation in terms of the tailored construction, no secondary fragments as defined above are substantially configured by the protection clothing unit. In the context of the concept according to the invention, in particular the use of inflexible, hard, firm, rigid, robust, stable, stiff, or semi-firm, non-flexible, movable, (de-)formable, or solid or brittle, respectively, components or component parts, respectively, is here dispensed with, wherein the afore-mention terms in the context of the concept according to the invention are in particular to be understood in such a manner that such components or component parts, respectively, which under a respective influence of a detonation or explosion, respectively, release secondary splinters or fragments, respectively, which in particular under the influence of the detonation or explosion, respectively, in turn can lead to injuries, or to a further worsening of injuries relating directly to the detonation or explosion, respectively, are dispensed with according to the invention in particular for configuring the protection clothing unit according to the invention. The protection clothing unit according to the invention herein is in particular conceived in such a manner that a high wear comfort and simplified and rapid undressing are moreover guaranteed.

A core concept of the present invention moreover also lies in that the splinter protection provided according to the invention can be individually adapted by way of the special configuration and arrangement of in particular splinter protection planar elements that provide the splinter protection, specifically both with a view to the respective risk situation (that is to say in particular depending on the risk of the confrontation with non-conventional blasting devices) as well as with a view to the individual constitution of the wearer of the protection clothing unit according to the invention.

Summarizing, in the context of the present invention a protection clothing unit based on protection clothing pieces in the manner of a clothing system is thus provided, said clothing system offering efficient protection in relation to effective forces which arise in particular in the context of the detonation or explosion, respectively, of non-conventional blasting devices, wherein additional risks of injury which can be linked with the protection clothing unit per se, or can result therefrom, respectively, are correspondingly minimized. The concept according to the invention moreover enables fastest-possible on-the-scene care for a wounded person, or for a wounded wearer, respectively, in particular on account of the simple undressing, or removal, of the protection clothing unit from the wearer, or on account of the simple release from the protection clothing unit, respectively, wherein this can be performed without any further auxiliary means, or using auxiliary means that are usually already available, respectively.

The protection clothing unit according to the invention herein is in particular a protection unit, or a corresponding protection system, respectively, based on individual protection clothing pieces or protection clothing elements, respectively, wherein the protection clothing unit according to the invention by configuring and tuning the individual protection clothing pieces can also be configured in such a manner that full-body protection in relation to IED-based explosion effects, or additional cutting protection as well as a maximum in terms of wear comfort, respectively, is provided.

Summarizing, the protection clothing unit according to the invention is in particular conceived such that no elements or component parts, respectively, forming secondary splinters or fragments, respectively, are at least substantially used. Specific separating or opening installations, respectively, moreover enable an affected person, or the wearer of the protection clothing, respectively, to be released from the clothing, specifically without the person or the wearer, respectively, having to be undressed in a regular or complex manner, respectively. The separating or opening installation, respectively, according to the invention herein can be conceived so as to be based on a rapid-release mechanism for example.

Ballistic splinter protection based on the protection clothing unit according to the invention is thus provided according to the invention, an increased level of body protection in relation to splinters or fragments, respectively, being provided based on said ballistic splinter protection, in particular with a view to non-conventional blasting devices, wherein the creation of splinters or fragments, respectively, emanating from the protection clothing per se is moreover avoided. By virtue of the use according to the invention of special materials for the underlying protection clothing pieces, besides the outstanding fragment protection, a very positive wear comfort is also provided while avoiding the creation of fresh splinters or fragments, respectively, so to speak, this also leading to an improved wear acceptance by the wearer or user, respectively, since the protection clothing unit according to the invention, besides the outstanding and durable ballistic splinter protection, enables a high exchange of humidity and heat at a simultaneously positive air permeability of the underlying materials. Moreover, by virtue of the minor material thickness, a minor (area) weight in terms of the protection clothing unit according to the invention is also present, which contributes toward a high wear comfort and moreover does not lead to any notable compromises in terms of the mobility and the freedom of movement of the wearer or user, respectively.

On account of the concept according to the invention having the provision of the corresponding splinter protection properties, in some instances life-threatening injuries caused by the confrontation of a wearer of the protection clothing unit according to the invention with the explosion of non-conventional blasting devices are significantly reduced, this leading to an increase in terms of the survival possibility or recovery, respectively. In particular, effective protection of physiologically relevant body portions, in particular also with a view to the artery or vein system, respectively, is also present based on the concept according to the invention.

According to a first aspect of the present invention, the present invention thus relates to a protection clothing unit 1, in particular a textile protection clothing unit, preferably a protection clothing unit having splinter and/or fragment protection, or having a ballistic protection function, preferably having a protection function in relation to splinters and/or fragments that are caused and/or released by detonation or explosion, respectively, wherein the protection clothing unit 1 has or is composed of at least one, in particular textile, protection clothing piece 2, preferably having a protection function in relation to splinters and/or fragments that are caused and/or released by detonation or explosion, respectively, wherein the protection clothing piece 2 is configured in such a manner that the protection clothing piece 2, in particular under the influence of an explosion or under a ballistic effect, respectively, preferably while hit by primary splinters and/or primary fragments, in particular at least in portions and/or in regions, preferably across the at least substantially entire area of the protection clothing piece 2, does at least not substantially release and/or configure any secondary splinters and/or secondary fragments, and/or wherein the protection clothing piece 2, in particular at least in portions and/or in regions, preferably across the at least substantially entire area of the protection clothing piece 2, does at least not substantially have any components and/or component parts which release or configure, respectively, secondary splinters and/or secondary fragments, and/or wherein the protection clothing piece has at least one separating or opening installation 3, respectively, in particular for the at least partial and/or portion-wise opening of the protection clothing piece 2, preferably for the purpose of an in particular emergency-related or accelerated, respectively, undressing of a wearer of the protection clothing piece 2, or for the purpose of an in particular emergency-related or accelerated, respectively, removal of the protection clothing piece 2, respectively, wherein the separating or opening installation 3, respectively, does at least not substantially have any components and/or component parts which release or configure, respectively, secondary splinters or secondary fragments, respectively.

Figure 2:
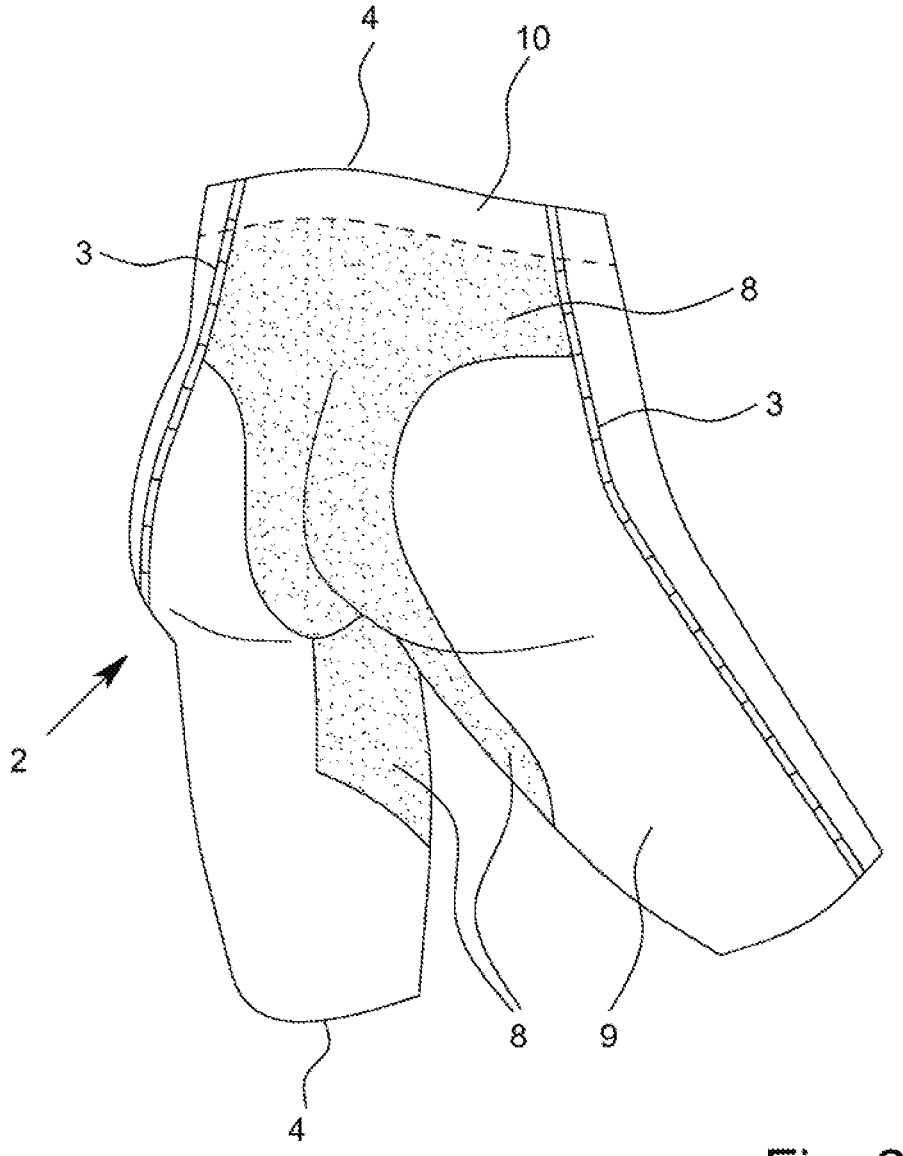
FIG. 2 shows a schematic illustration of an offset plan view of the rear side of a protection clothing unit according to the invention, or of a respective protection clothing piece in the form of short-leg underpants, respectively, according to which the underpants in the external regions thereof have longitudinally running separating or opening installations, respectively, and moreover onward running splinter protection planar elements, wherein the underpants do at least not substantially have any components or component parts, respectively, which release or configure, respectively, secondary splinters or secondary fragments, respectively.
Figure 5:
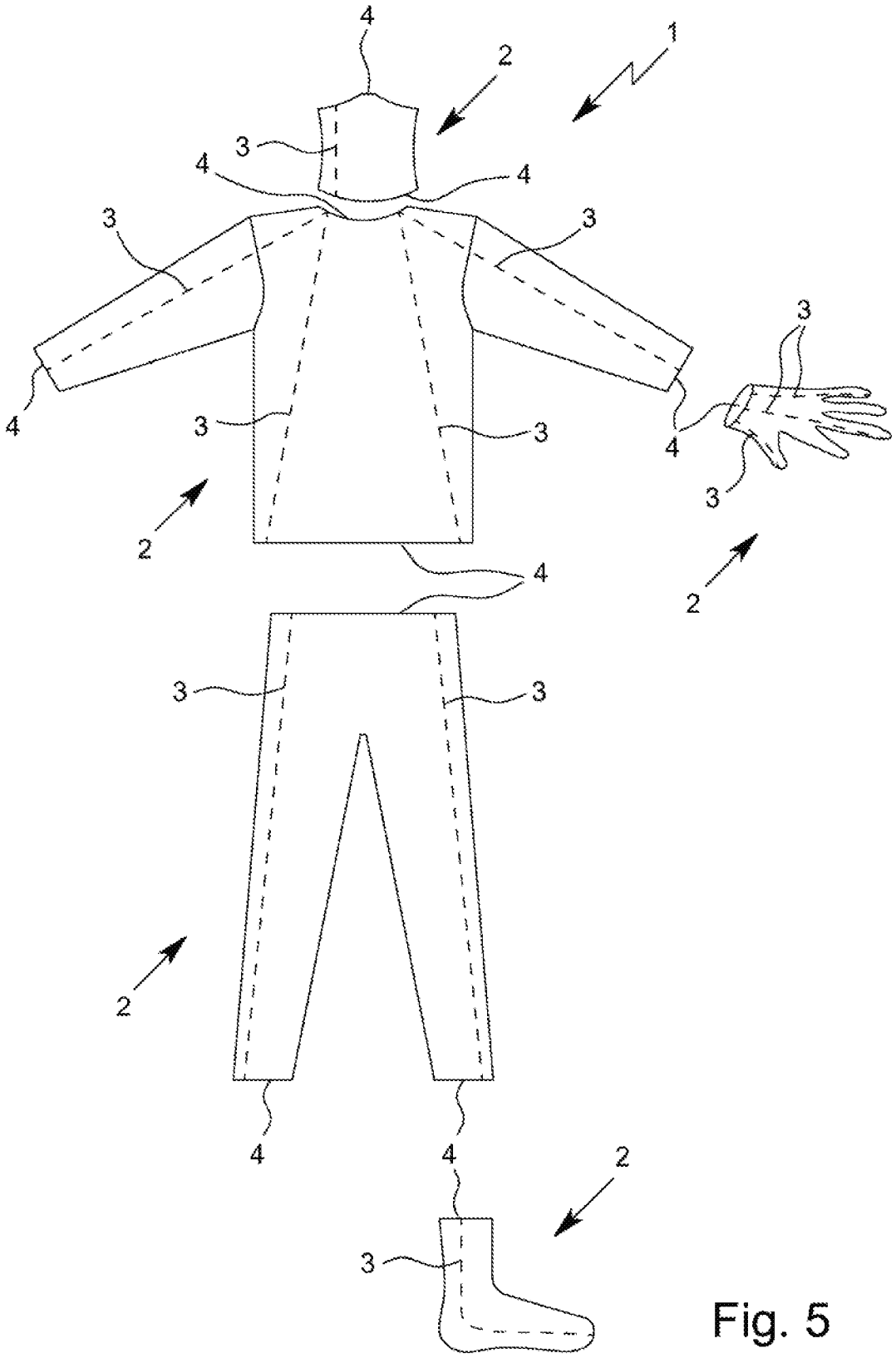
FIG. 5 shows a schematic plan view of a protection clothing unit according to the invention, having mutually dissimilar protection clothing pieces in the form of neck protection, an undershirt or overshirt, respectively, as well as underpants or over pants, respectively, wherein the respective separating or opening installations, respectively, are disposed between two openings for receiving or introducing, respectively, a body part and connect said two openings; moreover, further protection clothing pieces in the form of a glove as well as a sock or of an overshoe, respectively, are schematically illustrated, wherein the respective separating or opening installations, respectively, extend from the respective opening of the protection clothing piece into the protection clothing piece, and terminate in the region opposite the opening, in particular in the opposite finger or toe region, respectively

A protection clothing unit 1 of this type according to the invention, or a corresponding protection clothing piece 2, respectively, can be derived, for example, from FIG. 1, FIG. 2, as well as FIG. 5.

According to the invention, it can be in particular provided that the portions or regions, respectively, of the protection clothing piece 2 which do at least not substantially release or configure, respectively, any secondary fragments, in the worn or use state, respectively, of the protection clothing piece 2, are assigned to body portions having an increased risk of injury or having vital functions or organs, respectively, and/or cover said body portions. In particular in this context the body portions can be selected from the group of (i) lower extremities; (ii) genitals as well as internal sexual organs; (iii) bladder and urinal tract (urogenital tract); (iv) perineal and anal region; (v) lower abdomen with intestine, kidneys, spleen, and liver; (vi) in particular the lateral torso with parts of the lung lobes; (vii) rear torso in the renal pelvis region and the spine; (viii) upper extremities and shoulder region; and (ix) neck and lower facial part. Consequently, further protection of regions or portions, respectively, of the body of a wearer that are associated with vital functions is thus enabled according to the invention, wherein in this context, in some instances severe injuries in particular to the artery or vein system, respectively close to the surface as well as to the skin surface, which are linked with the secondary splinters or fragments, respectively, in particular by the penetration of splinters or fragments, respectively, into the aforementioned body portions, are also prevented.

In this context it can moreover be in particular provided according to the invention that at least 60%, in particular at least 80%, preferably at least 90%, preferably at least 95%, particularly preferably at least 99%, most particularly preferably at least 99.5%, furthermore preferably 100%, of the area of the protection clothing piece 2 does at least not substantially release or configure, respectively, any secondary splinters and/or secondary fragments, or does at least not substantially have any components and/or component parts which release and/or configure secondary splinters and/or secondary fragments, respectively.

The term of releasing secondary splinters or secondary fragments, respectively, with a view to the protection clothing unit 1 according to the invention is in particular to be understood in such a manner that these herein are in particular such splinters or fragments, respectively, which emanate from the protection clothing per se, on the one hand, and which are released from the protection clothing unit, for example, by the detonation or explosion shockwave, respectively, and/or by the impact or the hit, respectively, by primary splinters or fragments, respectively, as well as other secondary splinters or fragments, respectively, and which moreover can lead to further injuries, or to the worsening of injuries already present. The secondary splinters or fragments, respectively, in question herein are in particular such splinters or fragments, respectively, which have an irregular and optionally sharp-edged shape and/or which have a splinter or fragment weight, respectively, of at least 1 mg, in particular at least 5 mg, preferably at least 10 mg, preferably at least 50 mg, particularly preferably at least 500 mg, or more.

The secondary splinters or fragments, respectively, in question are moreover in particular such splinters or fragments, respectively, which are present in particular in the form of rigid or firm or inflexible, respectively, splinters or fragments, respectively, or which in particular comprise or are composed of a material in the form of metal, wood, (hard) plastics materials, glass, ceramics, respectively; by contrast, fragments of a textile origin generally such as, for example, fragments of an in particular soft or flexural or flexible, respectively, textile planar material, or corresponding yarn, doubled yarn, thread, or fiber fragments, respectively, which in the case of a detonation or explosion, respectively, can be released from the protection clothing unit for example in the context of the present invention are generally not included as the respective secondary splinters or secondary fragments, respectively.

For example, the term secondary splinters or secondary fragments, respectively, in particular based on inflexible, semi-firm or firm elements, respectively, can in general be splinters or fragments, respectively, emanating from an underlying clothing per se on account of an influence of a detonation or explosion, respectively, wherein these herein can be, for example, such splinters or fragments, respectively, which on account of the destruction of zip fasteners, buttons, hooks, eyelets, cord stoppers, cord ends, locks, buckles, assembly or fastening elements, respectively, carrying units, containers, containers fastened to the equipment, wherein the aforementioned components are in particular composed of or comprise, respectively, the aforementioned materials can be. Secondary splinters or fragments, respectively, of this type are not released, based on the concept of the invention.

Consequently, effective splinter protection is also provided from that end in the context of the concept according to the invention, since the aforementioned splinters or fragments, respectively, in the context of the concept according to the invention are at least not substantially released, or are at least not substantially created, respectively.

The protection clothing unit according to the invention herein can be present in numerous forms and design embodiments, as is set forth hereunder:

The protection clothing unit 1 can in particular be configured as upper wear or as underwear, respectively.

The protection clothing unit 1 can moreover be configured so as to be in one part or multiple parts, preferably multiple parts. Correspondingly, in particular one or a plurality of protection clothing pieces 2 are provided for configuring the protection clothing unit 1 according to the invention.

According to the invention, the protection clothing unit 1 can have or be composed of, respectively, at least one protection clothing piece 2 selected from the group of underpants, undershirts, and/or selected from the group of pants, pullover pants, overshirts (pullovers), jackets, pullover jackets, ponchos, overalls, socks, pullover shoes, gloves, collars, tubular wear, covers, hoods, hats, arm warmers, leg warmers, and combinations thereof.

It can likewise be provided according to the invention that at least two protection clothing pieces 2 are configured so as to be connectible, or are connected, to one another or among one another, respectively, and/or to the protection clothing unit 1. The protection clothing pieces 2 herein can be durably or releasably connected to one another or to the protection clothing unit 1, respectively. The connection herein can in particular be performed by means of stitching, welding, adhesive bonding, or by means of a seamless connection. A releasable connection can in particular be performed by means of a hook-and-loop fastener element or the like. In terms of the above it should also be guaranteed that the components used for the connection do at least not substantially configure any secondary splinters or fragments, respectively.

In as far as the protection clothing piece 2 underlying the protection clothing unit 1 according to the invention is furthermore concerned, said protection clothing piece 2 can thus be configured, for example, as upper wear or underwear, respectively.

The protection clothing piece 2 can in particular be configured so as to be in one part.

The protection clothing piece 2 can moreover be configured as underpants or an undershirt. The protection clothing piece 2 can in particular be configured as pants, pullover pants, undershirt, overshirt, jacket, pullover jacket, poncho, overall, sock, pullover shoe, glove, collar, tubular wear, cover, hood, hat, arm warmer, or leg warmer. In particular, individual protection relating to specific body regions with the simultaneously high variability or adaptability, respectively, can be provided on account of the combination of the aforementioned protection clothing pieces.

According to the invention it can moreover also be provided that the protection clothing unit 1 per se according to the invention is configured as upper wear and/or as underwear and has at least one, preferably separate, head and/or face protection, neck protection, shoulder protection, arm protection, hand protection, foot protection, body protection, torso protection, genital and/or anal protection and/or leg protection, in particular in the form of the protection clothing piece 2. A further protection functions which is individually adapted to special body regions can be provided on account thereof, specifically in particular based on further protection clothing pieces 2 which can be worn or removed, respectively, in a mission-specific or application-specific manner, respectively, for example.

In as far as the avoidance of the creation or release, respectively, of secondary splinters or fragments, respectively, emanating from the protection clothing unit 1 or from the protection clothing piece 2, respectively, or from the separating or opening installation 3, respectively, is concerned, in terms thereof a multiplicity of further measures can be thus provided according to the invention, or the following can be present:

According to the invention it arises in particular that the protection clothing unit 1 or the protection clothing piece 2, respectively, or the separating or opening installation 3, respectively, in particular under the influence of an explosion and/or under a ballistic effect, in particular while hit by primary splinters and/or primary fragments, does at least not substantially release and/or configure any secondary splinters and/or secondary fragments composed of a non-textile material, in particular any secondary splinters and/or secondary fragments composed of metal and/or wood and/or (hard) plastics material and/or glass and/or ceramics.

In this context it is in particular provided that the protection clothing unit 1 or the protection clothing piece 2, respectively, in particular the separating or opening installation 3, respectively, does at least not substantially have any non-textile components and/or component parts which release and/or configure secondary splinters and/or secondary fragments, in particular any components and/or component parts which have or are composed of metal and/or wood and/or (hard) plastics material and/or glass and/or ceramics.

In particular, it can be provided according to the invention that the protection clothing unit 1, or the protection clothing piece 2, in particular the separating or opening installation 3, respectively, in particular under the influence of an explosion and/or under a ballistic effect, in particular while hit by primary splinters and/or primary fragments, does at least not substantially release or configure any secondary splinters and/or secondary fragments which lead to severe and/or vital injuries, in particular does at least not substantially release or configure, respectively, any secondary splinters and/or secondary fragments which penetrate the body of the wearer of the protection clothing 1 and/or of the protection clothing piece 2 and/or lead to the destruction of or to injury to, respectively, physiologically important body structures, in particular blood vessels, nerve tracts, organs, bones, or the like.

In this context, it is particularly advantageous according to the invention, when the protection clothing unit 1 or the protection clothing piece 2, in particular the separating or opening installation 3, respectively, does at least not substantially have any components and/or component parts based on or in the form of metal and/or wood and/or (hard) plastics material and/or glass and/or ceramics, wherein the components or component parts stated in this regard are in particular selected from metal-based and/or wood-based and/or (hard) plastics material-based and/or glass-based and/or ceramics-based components.

In particular it can be provided according to the invention that the protection clothing unit 1 or the protection clothing piece 2, respectively, in particular the separating or opening installation 3, respectively, does at least not substantially have any components or component parts, respectively, based on or in the form of, respectively, in particular inflexible and/or hard and/or firm and/or rigid and/or robust and/or stable and/or stiff and/or semi-firm and/or non-flexible and/or slightly flexible and/or movable and/or (de-)formable and/or solid and/or brittle closure elements and/or assembly and/or fastening elements, in particular wherein the closure element or the assembly and/or fastening element, respectively, is selected from the group of zip fasteners; buttons; hooks; eyelets; stopper and/or fixing elements, in particular band and/or cord stoppers; end and/or terminal caps and/or sleeves, in particular band and/or cord ends and/or terminal caps; press studs; rivets; clips; locks; buckles, and combinations thereof.

For the avoidance of the formation of secondary splinters or fragments, respectively, emanating from the protection clothing unit 1 or the protection clothing piece 2, respectively, or the separating or opening installation 3, respectively, per se it can furthermore be provided that the protection clothing unit 1 or the protection clothing piece 2, in particular the separating or opening installation 3, respectively, moreover does at least not substantially has any components and/or component parts based on or in the form of, respectively, in particular inflexible and/or hard and/or firm and/or rigid and/or robust and/or stable and/or stiff and/or semi-firm and/or non-flexible and/or slightly flexible and/or movable and/or (de-)formable and/or solid and/or brittle and carrying and/or receptacle units which in particular are fastened or fixed, respectively, to the protection clothing unit or the protection clothing piece, respectively, in particular receptacle containers or the like. After all even the risk of the formation of further splinters or fragments, respectively, in the case of an effect of an explosion or detonation, respectively, emanates from objects of this type.

It thus arises in particular that the protection clothing unit 1 according to the invention, or the corresponding protection clothing piece 2, respectively, does at least not substantially have any components or component parts, respectively, which release or configure, respectively, secondary splinters or secondary fragments, respectively, this leading to an effective avoidance of secondary splinters or fragments, respectively, emanating from the protection clothing unit 1 per se, and thus to a further improved protection performance of the protection clothing unit 1 according to the invention.

In principle however, it can be provided according to the invention that the protection clothing unit 1 or the protection clothing piece 2, respectively, has at least one soft or flexible or elongatable or elastic or non-splintering or non-fragmenting, respectively, function or closure component, respectively, or that the protection clothing unit 1 or the protection clothing piece 2, respectively, has at least one function or closure component based on or in the form of, respectively, soft plastics materials or rubber or natural rubbers or silicones or textile materials, respectively. The function or closure components in question can in particular be such elements which under the effect of an explosion or detonation, respectively, do not release any secondary splinters or fragments, that is to say that at least not substantially any secondary splinters or fragments, respectively that lead to further injuries or to the worsening of injuries caused directly or indirectly, respectively, already by the explosion or detonation, respectively, are released by the function or closure components, respectively, in question.

According to the invention, a targeted omission in terms of elements or component parts, respectively, or components, respectively, that form secondary splinters or secondary fragments, respectively, is thus in particular resorted to in the protection clothing unit according to the invention, wherein, as stated above, in particular no inflexible, hard, firm, rigid, robust, stable, stiff, (de-)formable, or flexural, respectively, elements or components, respectively, are used. By contrast, according to the invention, the use of elastic, flexible, or resilient, respectively, components, in particular based on textile materials or the like, is significantly resorted to.

Moreover, according to the invention a design embodiment of the protection clothing unit 1 or of the protection clothing piece 2, respectively, can also be present in that, for example, upper extensions or lower extensions, respectively, are used or are present, respectively. According to the invention, the use of movable, formable and/or resilient cut parts, or textile planar materials, respectively, is also in particular considered with a view to the design embodiment or the construction, respectively, of the protection clothing unit 1 according to the invention. In the context of the present invention, connection elements based on hook-and-loop fasteners such as connections based on hook and pile, as well as rubbers or elastic bands, respectively, or the like can also be considered in particular.

As has been stated above, the protection clothing unit 1 or the protection clothing piece 2, respectively, is equipped with at least one special separating or opening device 3, respectively.

According to the invention it is herein provided in particular that the protection clothing unit 1, or the protection clothing piece 2, respectively, is capable of being opened or separated, respectively, in particular at least in portions, preferably completely, along the separating or opening installation 3, respectively. The rapid removal of the clothing from the wearer is in particular guaranteed on account thereof, in particular wherein the wearer having an injury is further destressed, for example by avoiding complex body movements.

Figure 3:
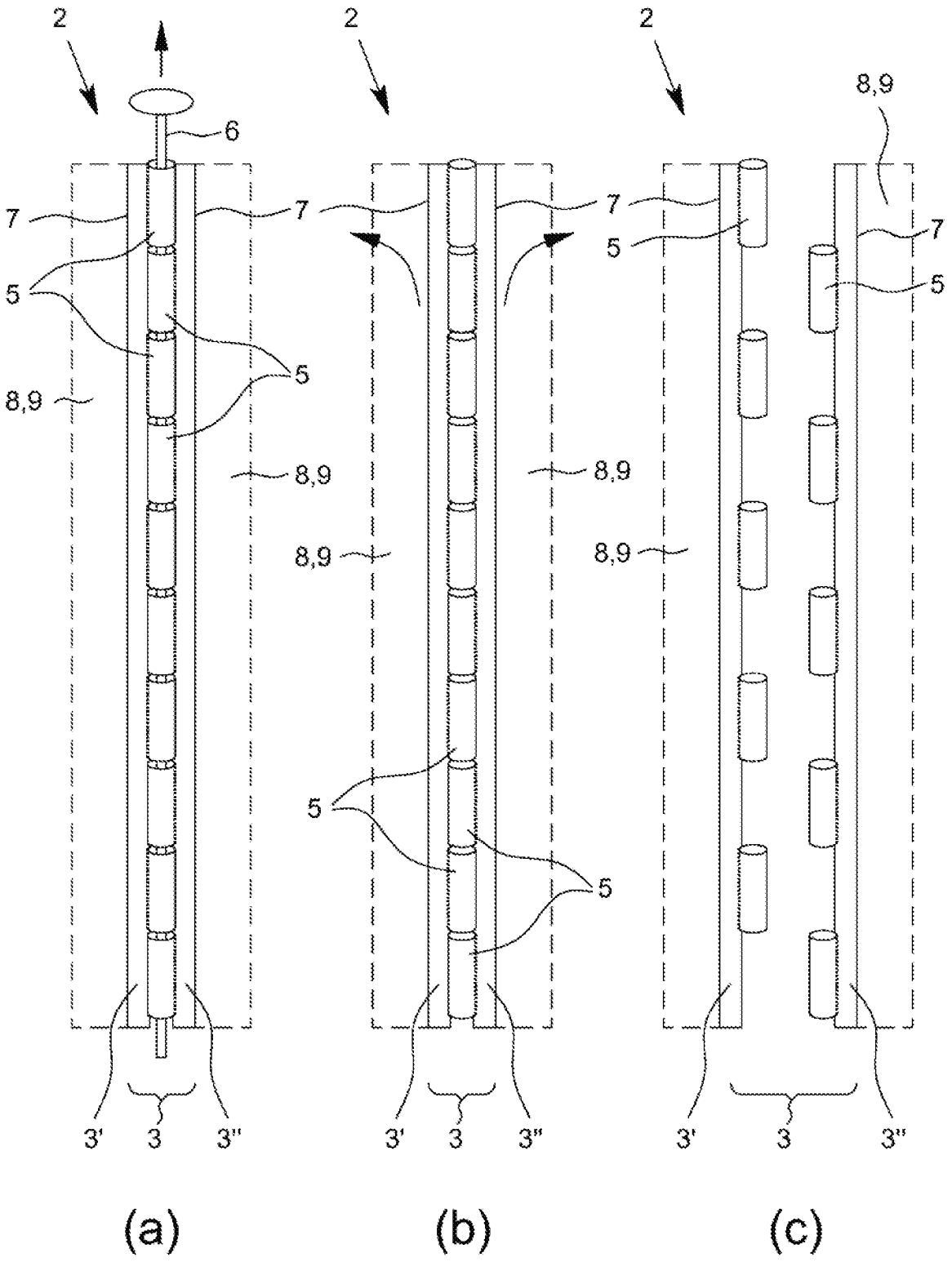
FIG. 3 shows a schematic illustration of a separating or opening installation, respectively, which is disposed in a protection clothing unit, or in a protection clothing piece, respectively, according to the invention, wherein the separating or opening installation, respectively, has two interacting, or mutually corresponding, respectively, separating or opening means, respectively, having in each case sleeve-shaped receptacle elements, and wherein the receptacle or opening means, respectively, are in each case disposed on, or fastened to, respectively, mutually opposite peripheries of the protection clothing piece; in this context, illustration (a) shows a closed state of the separating or opening installation, respectively, wherein the respective connection or receptacle elements, respectively, engage in one another and are fixed or secured, respectively, by way of a closure or opening element, respectively, which runs through the respective connection or receptacle elements, respectively; illustration (b) furthermore shows a corresponding separating or opening installation, respectively, having a closure or opening element, respectively, which has been removed, or has been extracted from the connection or receptacle elements, respectively, wherein the separating or opening installation, respectively, is unlocked on account thereof and can correspondingly be opened; illustration (c) furthermore shows the opened state of a separating or opening installation, respectively, having the associated spacing of the mutually opposite receptacle or opening means, respectively, having the respective connection or receptacle elements, respectively.

In as far as the separating or opening installation 3, respectively, provided in the context of the present invention is generally concerned, such as said separating or opening installation 3, respectively, is illustrated in particular in FIG. 3, said separating or opening installation 3, respectively, thus enables a rapid removal of the protection clothing unit 1, or rapid undressing of a wearer wearing the protection clothing unit 1 according to the invention, this being of particularly great importance with a view to an ideally rapid medical on-the-scene care in the context of the presence of an injury. The functioning mode of the separating or opening installation 3, respectively, used according to the invention herein, without wanting to be limited thereto, is in particular to be seen in that in the opened state of the separating or opening installation 3, respectively, the protection clothing unit 1 or the underlying protection clothing piece 2, respectively, is opened or opens, respectively, at defined locations, and simple undressing, or a simple removal of clothes, respectively, specifically in particular also while avoiding often complex body movements that are commonplace in the context of the removal of conventional clothing pieces is thus possible, this leading to further gentle treatment of the wearer. The separating or opening installation 3, respectively, in the closed state moreover guarantees the protection clothing unit 1 according to the invention to be worn in a safe and optimal manner, wherein neither the stability of the clothing pieces nor the design fit thereof are further compromised, in particular since the device configures a stable closure and since it can be provided according to the invention that the separating or opening installation 3, respectively, per se is configured so as to be flexural or flexible, respectively, and moreover can run in the region of commonplace seam connections such that the fit when worn, or the design fit, respectively, is at least not substantially influenced in a disadvantageous manner.

The separating or opening installation 3, respectively, used according to the invention is in particular such a construction which is integrated in the protection clothing unit 1 or the protection clothing piece 2, respectively. The separating or opening installation 3, respectively, is in particular such a construction which, when activated in a corresponding manner, immediately opens the underlying protection clothing unit 1, or separates part-regions from the protection clothing unit 1. Consequently, a wounded wearer, for example, can be released directly from the clothing, in particular since regular undressing is not required.

The separating or opening installation 3, respectively, used according to the invention herein can in particular be a rapid-release or emergency-release device, respectively, or the like, in particular as is defined hereunder. Accordingly the separating or opening installation 3, respectively, is a rapid-release system or an emergency-release system, respectively, in particular for preparing or carrying out, respectively, medical measures, or the like.

In as far as the arrangement of the separating or opening installation 3, respectively, in the protection clothing unit 1 or the protection clothing piece 2, respectively, is concerned, said arrangement can thus vary in large ranges, as is visualized in FIG. 5, for example.

According to the invention it is preferable herein, when the separating or opening installation 3, respectively, is disposed or configured, respectively, in such a manner that the protection clothing unit 1 or the protection clothing piece 2, respectively, is capable of being opened or separated, respectively, at least substantially in the longitudinal direction. In particular, the separating or opening installation 3, respectively, in this case extends at least substantially in the longitudinal direction of the underlying protection clothing unit 1 or of the protection clothing piece 2, respectively.

The term "in the longitudinal direction", which according to the invention is to be understood in a broad manner, relates here in particular to the longitudinal extent of the underlying protection clothing unit 1 or of the protection clothing piece 2, respectively, or in the worn state to the longitudinal axis of the human body or the wearer, respectively, of the protection clothing unit 1, respectively. For example, the separating or opening installation 3, respectively, in the worn state can run along a leg, along the arms, or along the torso, respectively, from top to bottom so to speak, or vice versa, respectively.

Accordingly, the separating or opening installation 3, respectively, can be disposed at least substantially in the longitudinal direction of the protection clothing unit 1 or of the protection clothing piece 2, respectively. Reference to this end can also be made to FIG. 5.

According to the invention it can moreover be provided that the separating or opening installation 3, respectively, is disposed laterally or on the external side, respectively, in the protection clothing unit 1 or the protection clothing piece 2, respectively. This herein, in terms of the worn state of the protection clothing piece 2, can be, for example, the leg or arm external region, respectively, or the (external) lateral region of the torso of a wearer, respectively. Reference can correspondingly be made to FIG. 1 as well as FIG. 5, for example.

According to the invention it is moreover advantageous when the separating or opening installation 3, respectively, is disposed along usual or predefined, respectively, cutting or seam regions, respectively, of the protection clothing unit 1 or the protection clothing piece 2, respectively. The separating or opening installation 3, respectively, can correspondingly replace an originally provided seam, so to speak, or be disposed or fastened, respectively, in the place of said seam, respectively, wherein a secure and durable connection of the corresponding portions is likewise present in the closed state. The portions herein can be formed by planar materials or elements 8, 9, respectively, of the protection clothing unit 1 or of the protection clothing piece 2, respectively, said materials or elements yet to be described in detail hereunder.

According to the invention it can furthermore be provided that the separating or opening installation 3, respectively, at least in portions is covered and/or overlapped by an in particular textile planar material. The separating or opening installation 3, respectively, can moreover have at least one, in particular textile, cover or overlap, respectively, in particular in the form of a lower extension or upper extension, respectively. On account thereof, the separating or opening installation 3, respectively, is further protected in particular also in relation to an effect of an explosion. The textile planar material, or the textile cover, respectively, can in particular be provided by textile planar materials that configure the protection clothing unit 1 or the protection clothing piece 2, respectively, wherein a respective blank of the textile component parts in question can correspondingly be present.

According to the invention it can furthermore be provided that the separating or opening installation 3, respectively, in particular in the region of the end portions or ends, respectively, of the separating or opening installation 3, respectively, is covered or secured, respectively, by an, in particular textile, cover material or element 11 respectively. Reference can correspondingly be made in particular to FIG. 4. In this context, the textile cover planar material or element 11, respectively, can be configured so as to be removable or foldable, respectively. In general, the textile cover material or element 11, respectively, can preferably in portions be connected, in particular stitched, to the protection clothing piece 2, as is likewise illustrated in FIG. 4. It can likewise be provided that the textile cover material or element 11, respectively, is connected or secured, respectively, with a securing or fixing means 12, respectively, for example in the form of a hook-and-loop fastener to the protection clothing piece. On account thereof, the separating or opening installation 3, respectively, can further be secured in particular with a view to any erroneous operation or erroneous triggering, respectively, and moreover also be protected in relation to an effect of an explosion.

According to a further embodiment according to the invention it can moreover be provided that the separating or opening installation 3, respectively, is at least in portions, preferably completely, configured so as to be optically and/or visually dissimilar, particularly dissimilar in terms of color, to the protection clothing piece 2, in particular to the regions of the protection clothing piece 2 that are contiguous to the separating or opening installation 3, respectively. On account thereof, it is in particular guaranteed that the separating or opening installation 3, respectively, is visually easy to find. Moreover, an optical or visual, respectively, differentiation capability enables improved or simplified, respectively, opening, for example in the case of the separating or opening installation 3, respectively, being configured so as to be capable of being cut open, or in the form of a cutting or trimming region, respectively, as yet is stated hereunder, since the guiding of the cutting or trimming tool is facilitated on account thereof.

Figure 4:
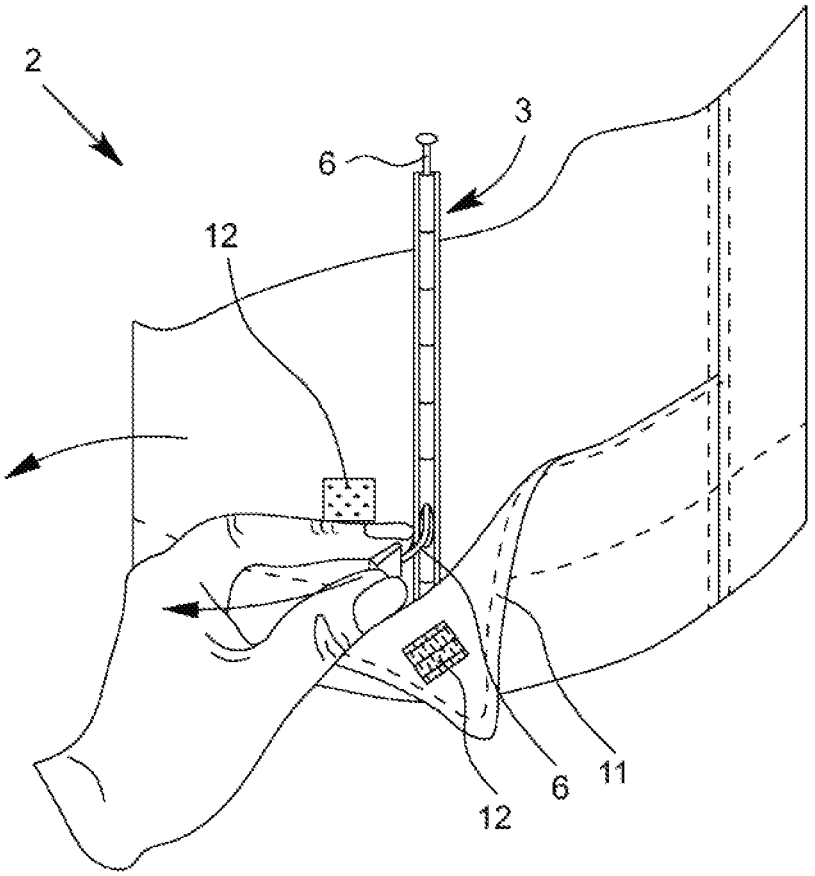
FIG. 4 shows a schematic plan view of an end portion or region, respectively, of a protection clothing unit, or a protection clothing piece, respectively, according to the invention, according to which the end region of a separating or opening installation, respectively, by way of a cover material or element, respectively, which is capable of being folded down is configured so as to be capable of being covered or secured, respectively, wherein the cover material or element, respectively, is at least in portions connected to the protection clothing piece, and wherein the cover material or element, respectively, can additionally be fastened to the protection clothing piece by way of a securing or fixing means, respectively.

As is illustrated in particular in FIG. 1, FIG. 2, and FIG. 4, it can be provided according to the invention that the separating or opening installation 3, respectively, is incorporated or integrated, respectively, in the protection clothing unit 1 or in the protection clothing piece 2, respectively.

It can moreover be provided according to the invention that the separating or opening installation 3, respectively, is disposed so as to be linear or arcuate, respectively, in the protection clothing unit 1 or the protection clothing piece 2, respectively.

In particular, the separating or opening installation 3, respectively, in the closed state, connects opposite peripheries or peripheral portions, respectively, of the protection clothing unit 1, such as are obtained, for example, by a corresponding blank of the textile planar elements that configure the protection clothing unit 1 or the protection clothing piece 2, respectively (cf. FIG. 1, FIG. 2, as well as FIG. 4). The separating or opening installation 3, respectively can in particular be used as a replacement for respective seam profiles or the like, as has been stated above. The underlying peripheries or peripheral portions, respectively, herein can in particular be formed by planar materials or elements 8, 9 of the protection clothing unit 1 or the protection clothing piece 2, respectively, which are yet to be described in detail hereunder.

With a view to the separating or opening installation 3, respectively, provided according to the invention it can moreover in particular arise that in the case of the opening or activating, respectively, of the separating or opening installation 3, respectively, the protection clothing unit 1 or protection clothing piece 2, respectively, is at least in portions, preferably completely, opened or separated, respectively, along the separating or opening installation 3, respectively. A rapid removal, or undressing, respectively, of the protection clothing unit 1 or the protection clothing piece 2, respectively, is enabled on account thereof.

In as far as the arrangement of the separating or opening installation 3, respectively, is considered in general, said separating or opening installation 3, respectively, can thus be disposed in the protection clothing unit 1 or the protection clothing piece 2, respectively, so as to proceed from an opening 4 (for example a foot opening or the like) of the protection clothing unit 1 or of the protection clothing piece 2, respectively.

The separating or opening installation 3, respectively, can in particular extend into the protection clothing unit 1 or into the protection clothing piece, respectively, so as to proceed from an opening 4 of the protection clothing unit 1 or the protection clothing piece 2, respectively.

This means in particular that in the case of an opening or activating, respectively, of the separating or opening installation 3, respectively, the protection clothing unit 1 or the protection clothing piece 2, respectively, is opened or separated, respectively, so as to proceed from an opening 4.

In this context, it can in particular be provided that the separating or opening installation 3, respectively, terminates in the protection clothing unit 1 or the protection clothing piece 2, respectively, or is not connected to the same opening 4 or nor to any further opening 4, respectively. In an analogous manner, the protection clothing unit 1 or the protection clothing piece 2, respectively, can be opened in portions or regions, respectively (for example in a profile of the separating or opening installation 3, respectively, so as to proceed from a foot opening to the knee region of long-legged underpants, wherein the lower leg, or the knee, respectively, of a wearer can be exposed on account thereof in a corresponding manner). Reference to this end can be made to FIG. 5.

However, it can be likewise also provided that the separating or opening installation 3, respectively, proceeding from an opening 4, is connected to the same opening 4 or extends thereinto, respectively. This can be the case, for example, for a torso opening (waist opening) of underpants or the like, wherein the separating or opening installation 3, respectively, opens into the torso opening then so to speak on both sides or by way of both ends, respectively, and runs along the perineal region, for example, such that it is possible for the underpants to be divided into two halves (left leg, right leg) on account thereof.

According to a particularly preferred embodiment according to the invention it can moreover be provided that the separating or opening installation 3, respectively, proceeding from a first opening 4, is connected to a further opening 4, in particular an opening 4 that is dissimilar to the first opening 4, or extends into said further opening 4. For example, the separating or opening installation 3, respectively, in the case of the clothing piece 2 being configured in the form of pants, can connect the foot opening to the torso or waist opening, respectively. Moreover, in the case of the clothing piece 2 being configured in the form of a shirt or the like, the separating or opening installation 3, respectively, can connect the torso or stomach opening, respectively, to the neck opening. Moreover, the separating or opening installation 3, respectively, can connect the hand opening to the neck opening. On account thereof it is enabled that the protection clothing piece 2 is completely separated. Reference to this end can also be made to the explanations hereunder.

According to a further embodiment according to the invention it can also be provided that the separating or opening installation 3, respectively, is not connected to an opening 4 of the protection clothing unit 1 or the protection clothing piece 2, respectively, or does not extend into said opening 4, respectively, or that the separating or opening installation 3, respectively, is at least substantially incorporated or integrated, respectively, in a fully circumferential manner in the protection clothing unit 1 or in the protection clothing piece 2, respectively. For example, in the case of the protection clothing piece 2 being configured in the form of pants, the separating or opening installation 3, respectively, can be disposed in the region of the knee, wherein the separation or opening installation 3, respectively, runs across the knee and terminates in the region of the thigh and the lower leg. Portion-wise opening of the protection clothing is enabled on account thereof.

According to a yet further embodiment of the present invention it can also be provided that the separating or opening installation 3, respectively, is configured in an encircling or circular, respectively, manner, or that the separating or opening installation 3, respectively, is incorporated or integrated, respectively, in an encircling or circular, respectively, manner in the protection clothing unit 1 or in the protection clothing piece 2, respectively. On account thereof, individual portions of the protection clothing piece 2 can be configured so as to be removable, for example, this possibly applying, for example, to a sleeve of the protection clothing piece 2 in the form of a shirt, or to a leg portion or part, respectively, of a protection clothing piece 2 in the form of pants, respectively.

The following can moreover also apply to the arrangement of the separating or opening device, respectively:

With a view to the arrangement of the separating or opening installation 3, respectively, in the protection clothing unit 1 or the protection clothing piece 2, respectively, it can in particular be provided according to the invention that one end or end portion, respectively, of the separating or opening installation 3, respectively, is connected to an opening 4 of the protection clothing unit 1 or the protection clothing piece 2, respectively, or extends into said opening 4, and another end or another end portion, respectively, of the separating or opening installation 3, respectively, is connected to the same opening 4, or extends into said opening 4, respectively. It can moreover be provided that one end of the separating or opening installation 3, respectively, is connected to a first opening 4 of the protection clothing unit 1 or of the protection clothing piece 2, respectively, or extends into said first opening 4, respectively, and another end of the separating or opening installation 3, respectively, is connected to a second opening 4, in particular an opening that is dissimilar to the first opening, of the protection clothing unit 1 or of the protection clothing piece 2, respectively, or extends into said second opening 4.

In this context, the terms "are connected" or "extends into", respectively, which according to the invention are to be understood in a broad manner, are in particular to be understood in such a manner that in the case of the separating or opening installation 3, respectively, being opened or activated, the underlying protection clothing unit 1 or the protection clothing piece 2, respectively, is also completely separated in the region of the opening. In other words, the separating or opening installation 3, respectively, preferably opens into the opening in question, such that correspondingly a complete separation is guaranteed.

It can likewise be fundamentally also provided that both ends of the separating or opening installation 3, respectively, are incorporated or integrated, respectively, in a fully circumferential manner or complete manner, respectively, in the protection clothing unit 1 or in the protection clothing piece 2. It can furthermore also be fundamentally provided that both ends of the separating or opening installation 3, respectively, are disposed so as to be mutually oriented or so as to be mutually contiguous, or transition into one another, respectively, or form a respective unit, wherein this design embodiment of the present invention can in particular be implemented with a view to the potential severance of individual portions such as a sleeve or a leg part, since an encircling or circular, respectively, arrangement of the separating or opening installation 3, respectively, can likewise be implemented on account thereof, so to speak. In as far as the opening 4 of the protection clothing unit 1 or the protection clothing piece 2, respectively, stated above is concerned, said opening 4 thus serves for receiving or introducing, respectively, a body part in particular in the worn or use state of the protection clothing unit 1 or the protection clothing piece 2. In this context, the opening in functional terms can be configured as a head opening, neck opening, stomach or pelvis opening, respectively, arm or hand opening, respectively, or as a foot or leg opening, respectively, so to speak.

According to the invention it can in principle also be provided that the opening 4, as is illustrated in FIG. 2, is provided with at least one waistband 10 or a connection means for the in particular reversible connection or fastening, respectively, of a further protection clothing piece 2. The separating or opening installation 3, respectively can in particular extend at least substantially completely across the waistband 10 or the connection means, respectively, as is likewise illustrated in FIG. 2.

Preferred embodiments according to the invention in terms of special arrangements of the separating or opening installation 3, respectively, in particular with a view to a specific configuration of the protection clothing unit 1 or the protection clothing piece 2, respectively, will be discussed hereunder:

In this context, FIG. 1 and FIG. 2 show an embodiment according to the invention, according to which the separating or opening installation 3, respectively, is connected to a foot or leg opening, respectively, on the one hand, and a stomach or pelvis opening, respectively, on the other hand, or wherein the separating or opening installation 3, respectively, extends from a foot or leg opening, respectively, on the one hand, to a stomach or pelvis opening, on the other hand, respectively. In this context, the protection clothing piece 2 can be configured as underpants, pants, or pullover pants. In this context, the separating or opening installation 3, respectively, can be disposed laterally or on the external side, respectively, in the protection clothing piece 2.

According to a further embodiment it can be provided that the separating or opening installation 3, respectively, is connected to an arm or hand opening, respectively, on the one hand, and a neck opening, on the other hand. The separating or opening installation 3, respectively, can in particular extend from an arm or hand opening, on the one hand, to a neck opening, on the other hand. In this context, the separating or opening installation 3, respectively, can be connected to an arm or hand opening, on the one hand, and a neck opening, on the other hand. In this context, the separating or opening installation 3, respectively, can extend from an arm or hand opening, respectively, on the one hand, to a neck opening, on the other hand. In this context, it can moreover be provided that the separating or opening installation 3, respectively, is connected to an arm or hand opening, respectively, on the one hand, and a stomach and/or pelvis opening, on the other hand. In particular, the separating or opening installation 3, respectively, can extend from an arm or hand opening, respectively, on the one hand, to a stomach or pelvis opening, respectively, on the other hand. In this context, it can likewise be provided that the protection clothing piece 2 is configured as an undershirt, overshirt, jacket, pullover jacket, poncho or overall. In this context, the separating or opening installation 3, respectively, can in each case be disposed laterally or on the external side or in the region of the front or rear, respectively, torso, in the protection clothing piece 2.

According to a further embodiment according to the invention, it can likewise be provided that the separating or opening installation 3, respectively, is connected to a head opening, on the one hand, and a neck opening, on the other hand. The separating or opening installation 3, respectively, can correspondingly extend from a head opening, on the one hand, to a neck opening, on the other hand. In this context, it is in particular provided that the protection clothing piece 2 is configured as head or face protection, respectively, neck protection, collar, or tubular wear. In particular, the separating or opening installation 3, respectively, can be disposed laterally or on the external side, respectively, in the protection clothing piece 2.

According to yet a further embodiment of the present invention it can furthermore be provided that the separating or opening installation 3, respectively, proceeding from an arm or hand opening, respectively, extends to a finger portion or region, respectively. To this end, it can in particular be provided that the protection clothing piece 2 is configured as a glove or pullover glove. The separating or opening installation 3, respectively, can correspondingly be disposed laterally and/or on the external side or rear side, respectively, in the protection clothing piece 2, in particular glove or pullover glove.

According to a further embodiment according to the invention the separating or opening installation 3, respectively, proceeding from a foot or leg opening, respectively, can extend to a toe portion or region, respectively. In this context, the protection clothing piece 2 can be configured as a sock or pullover shoe. The separating or opening installation 3, respectively, can correspondingly be disposed laterally or on the external side or rear side, respectively, in the protection clothing piece 2, in particular sock or pullover shoe.

According to the invention, it can be generally provided that the separating or opening installation 3, respectively, is configured so as to be capable of being used once or not reusable, respectively, or as a single-use separating or single-use opening installation, respectively. In this context, the separating or opening installation 3, respectively, can be configured so as to be capable of being irreversibly opened or not capable of being closed again, respectively.

By contrast, it can however also be provided according to the invention that the separating or opening installation 3, respectively, is configured so as to be capable of multiple use, or is configured as a multiple-use separating or multiple-use opening installation, respectively. Moreover, the separating or opening installation 3, respectively, can be configured so as to be capable of being reversibly opened or capable of being closed again.

In general, the separating or opening installation 3, respectively, can be configured so as to be capable of being separated, torn open, cut open, broken open, severed, and/or divided, in particular so as to be capable of being separated, torn open and/or cut open.

In as far as the configuration of the separating or opening installation 3, respectively, is furthermore concerned, said separating or opening installation 3, respectively, can thus have at least one first separating or opening means 3', respectively, and at least one second separating or opening means 3", respectively, as is illustrated in FIG. 3, said separating or opening means 3', 3" being in particular positioned or disposed, respectively, on mutually opposite peripheries of the protection clothing piece 2.

In this context, the first separating or opening means 3', respectively, and the second separating or opening means 3", respectively, can be attached or fastened, respectively, so as to be in particular mutually opposite on mutually opposite peripheries or peripheral portions, respectively, of the protection clothing unit 1 or the protection clothing piece 2, respectively, as is likewise illustrated in FIG. 3. The fastening herein can be performed for example by means of stitching, adhesive bonding, welding, or the like.

In this context, it is in particular provided according to the invention that the first separating or opening means 3', respectively, and the second separating or opening means 3", respectively, interact in particular for providing a closure or connection state, respectively, of the separating or opening installation 3, respectively.

The connection or receptacle elements 5, respectively, per se can in each case be disposed on or fastened to, respectively, mutually opposite peripheries 7 of the clothing piece 2. Moreover, the first separating or opening means 3', respectively, and the second separating or opening means 3", respectively, in a mutually independent manner can have or be composed of a material from the group of soft plastics materials, rubber, natural rubbers, silicones, textile materials, and the combinations thereof.

It can be provided according to the invention, as is likewise illustrated in FIG. 3, that the separating or opening installation 3, respectively, has or is composed of a multiplicity of connection or receptacle elements (connection or receptacle means, respectively) 5, respectively, in particular for receiving or guiding, respectively, the at least one closure or opening element 6, respectively.

Moreover, it can be provided according to the invention that the first separating or opening means 3', respectively, on the one hand, and/or the second separating or opening means 3", respectively, on the other hand, preferably the first separating or opening means 3', respectively, on the one hand, and the second separating or opening means 3", respectively, on the other hand, have/has or are/is composed of, respectively, in each case at least one connection or receptacle element 5, respectively, in particular in each case a multiplicity of connection or receptacle elements 5, respectively, in particular for receiving or guiding, respectively, at least one closure or opening element 6, respectively. Reference to this end can likewise be made to the illustration according to FIG. 3 and moreover to FIG. 4.

According to an embodiment according to the invention it can be provided herein that the connection or receptacle elements 5, respectively, are configured in the form of hollow elements, as is illustrated in FIG. 3. In this context, the connection or receptacle elements 5, respectively, can be selected from the group of sleeves, eyelets, and loop bands, in particular sleeves, in particular wherein the sleeves are configured in the form of hollow cylinders.

Moreover, the connection or receptacle elements 5, respectively, in particular the hollow elements, can be configured so as to be flexible or flexural, respectively. Moreover, the connection or receptacle elements 5, respectively, in particular the hollow elements, can comprise or be composed of a material configured so as to be flexible or flexural, respectively. In particular, the material of the connection or receptacle elements 5, respectively, in particular of the hollow elements, can be selected from the group of soft plastics materials, rubber, natural rubbers, silicones, textile materials, and the combinations thereof.

In as far as the separating or opening means 3', 3", respectively, are moreover concerned, said separating or opening means 3', 3", respectively, can thus in each case be configured so as to in particular be in one part, in particular wherein the respective connection or receptacle elements 5, respectively, can be attached to a corresponding connection portion and by way of the latter be connected to one another (cf. FIG. 3). However, it is likewise possible for the respective separating or opening installations 3', 3", respectively, to be configured so as to be in multiple parts, in particular based on individual connection or receptacle elements 5, respectively, or groups of connection or receptacle elements 5, respectively.

As is likewise illustrated in FIG. 3 and FIG. 4, it can be provided according to the invention that the separating or opening installation 3, respectively, has at least one closure or opening element 6, respectively, in particular for connecting the first separating or opening means 3', respectively, to the second separating or opening means 3", respectively, or for connecting connection or receptacle elements 5, respectively, of the separating or opening installation 3, respectively.

In this context, the closure or opening element 6, respectively, can have an elongate or stretched or elongated, respectively, shape. Moreover, the closure or opening element 6, respectively, can be configured so as to be flexible or flexural, respectively. In particular, the closure or opening element 6, respectively, can be configured so as to be thread-shaped, yarn-shaped, rope-shaped, or cord-shaped, respectively. The closure or opening element 6, respectively, can likewise be a thread, yarn, rope, or a cord, respectively. In general, the closure or opening element 6, respectively, can comprise or be composed of a material configured so as to be flexible or flexural, respectively. In this context, the material of the closure or opening element 6, respectively, can be selected from the group of soft plastics materials, rubber, natural rubbers, silicones, textile materials, and the combinations thereof, preferably textile materials. On this basis, a creation of secondary splinters or fragments, respectively, emanating from the protection clothing unit 1 is additionally counteracted.

According to an embodiment according to the invention, the closure or opening element 6, respectively, and the connection or receptacle elements 5, respectively, or the corresponding separating or opening means 3', 3", respectively, can be composed of the same material. In particular, the aforementioned components can be produced from a textile material.

As is likewise illustrated in FIG. 3, the connection or receptacle elements 5, respectively, which are disposed on or fastened to, respectively, one periphery 7 of the mutually opposite peripheries 7 of the protection clothing unit 1 or the protection clothing piece 2, respectively, can be mutually spaced apart. The spacing of two connection or receptacle elements 5 adjacent to the first periphery 7 can correspondingly be chosen in such a manner that a connection or receptacle element 5 of the other periphery 7 that is opposite the resulting gap is capable of being received or positioned in the gap.

According to the invention it can moreover be provided that the respective connection or receptacle elements 5, respectively, which are disposed on or fastened to, respectively, the first separating or opening means 3', respectively, on the one hand, and/or the corresponding periphery 7, and the respective connection or receptacle elements 5, respectively, which are disposed on or fastened to, respectively, the second separating or opening means 3" respectively, the corresponding periphery 7, on the other hand, or are mutually spaced apart. In particular, the spacing of two connection or receptacle elements 5, respectively, adjacent to the respective separating or opening means 3', 3", respectively, or the respectively corresponding periphery 7, respectively, can be chosen in such a manner that a connection or receptacle element 5 of the other separating or opening means 3', 3", respectively, or of the other periphery 7, respectively, that is opposite the resulting gap is capable of being received or positioned, respectively, in the gap. On account thereof, meshing of the corresponding connection or receptacle elements, so to speak, is guaranteed when the separating or opening installation 3, respectively, is closed (cf. FIG. 3).

As is likewise illustrated in FIG. 3, it can moreover be provided according to the invention that the connection or receptacle elements 5 which are disposed on or fastened to, respectively, a periphery 7 of the mutually opposite peripheries 7 of the protection clothing unit 1 or the protection clothing piece 2, respectively, are disposed or fastened, respectively, so as to be offset, in particular offset in terms of height, from the connection or receptacle elements 5 which are disposed on or fastened to, respectively, the other periphery 7. In this context, the offset, in particular offset in terms of height, can be chosen in such a manner that a connection or receptacle element 5 of the one periphery 7 is capable of being received or positioned, respectively, in a gap that is present between two neighboring connection or receptacle elements 5, respectively, of the other periphery 7.

According to the invention, it can be likewise provided that the connection or receptacle elements 5, respectively, which are disposed on or fastened to, respectively, the first separating or opening means 3', respectively, are disposed or fastened, respectively, so as to be offset, in particular offset in terms of height, from the connection or receptacle elements 5, respectively, which are disposed on or fastened to, respectively, the second separating and/or opening means 3", respectively. The offset, in particular offset in terms of height, can correspondingly be chosen in such a manner that a connection or receptacle element 5, respectively, of the first separating or opening means 3', respectively, is capable of being received or positioned, respectively, in a gap that is present between two neighboring connection or receptacle elements 5, respectively, of the second separating or opening means 3", respectively.

According to an embodiment according to the invention the first separating or opening means 3', respectively, and the second separating or opening means 3", respectively, can be at least substantially mutually identical opening means (in terms of shape) which are positioned at a corresponding mutual offset along the respective peripheries.

The functioning mode of the separating or opening installation 3, respectively, is described further hereunder:

It can thus be derived in particular from FIG. 3, according to the illustration (a) therein, that in the closed state of the separating or opening installation 3, respectively, the connection or receptacle elements 5 which are disposed on or fastened to, respectively, the one periphery, can be connected to or unified with, respectively, in particular by means of the closure or opening element 6, respectively, preferably in an alternate or alternating manner, respectively, the connection or receptacle elements 5, respectively, which are disposed on or fastened to, respectively, the other periphery 7.

In this context, in the closed state of the separating or opening installation 3, respectively, the connection or receptacle elements 5, respectively, of the first separating or opening means 3', respectively, or of the one periphery 7, respectively, can be unified with, or interconnected to, respectively, by means of the closure or opening element 6, respectively, preferably in an alternate or alternating or alternate manner, respectively, the connection or receptacle elements 5, respectively, of the second separating or opening means 3', respectively, or the other periphery 7.

In other words, it can arise according to the invention that the respective connection or receptacle elements 5, respectively, in an alternating arrangement in the closed state configure a continuous tube, so to speak, wherein the closure or opening element, respectively, functions as a quasi core which runs through the formed continuous cavity of the connection or receptacle elements 5, respectively.

As is likewise illustrated in FIG. 3, according to the illustration (a) therein, it arises in particular according to the invention that in the closed state of the separating or opening installation 3, respectively, the connection or receptacle elements 5, respectively, are acquired or fixed, respectively, by the closure or opening element 6, respectively. The closure or opening element 6, respectively, can correspondingly run through or along, respectively, the connection or receptacle elements 5, respectively.

The closure or opening element 6, respectively, for opening the separating or opening installation 3, respectively, can be removed by extraction, for example, wherein the respective connection or receptacle elements 5, respectively, of the one side of the separating or opening installation 3, respectively, can be separated from the connection or receptacle elements 5, respectively, of the other side of the separating or opening installation 3, respectively, (cf. illustration (b) according to FIG. 3), such that opening of the separating or opening installation 3, respectively, can correspondingly be carried out.

In this context, illustration (c) according to FIG. 3 shows the opened state of the separating or opening installation 3, respectively, used according to the invention, having the separation or spacing, respectively, of the first receptacle or opening means 3', respectively, of the corresponding connection or receptacle elements 5, respectively, on the one hand, and of the second receptacle or opening means 3", respectively, or of the corresponding connection or receptacle elements 5, respectively, on the other hand.

The special construction of the separating or opening installation 3, respectively, described above and in particular illustrated in FIG. 3, is associated with the fundamental advantage that a closure which is stable or capable of being stressed in mechanical terms or in terms of force, respectively, and which is durable is present in the closed state, on the one hand, said closure moreover being capable of being opened in a simple manner by removing the closure or opening element 6, respectively. The separating or opening installation 3, respectively, described above is moreover distinguished in that said separating or opening installation 3, respectively, can be configured in principle so as to be capable of being closed again, or can be closed again, in particular by reintroducing the closure or opening element, respectively, for example while using corresponding introduction aids or the like.

According to a further corresponding embodiment of the present invention it can also be provided that the connection or receptacle elements 5, respectively, of the one periphery 7 of the mutually opposite peripheries 7 of the protection clothing unit 1 or the protection clothing piece 2, respectively, and the connection or receptacle elements 5, respectively, of the other periphery 7 are configured or disposed, respectively, so as to be mutually form-fitting, this contributing in particular toward the stability of the resulting connection.

Further embodiments or configurations, respectively, of the separating or opening installation 3, respectively, will be discussed hereunder, wherein the present invention is however not limited thereto.

According to a further embodiment of the present invention it can be provided that the separating or opening installation 3, respectively, is configured in the form of a hook-and-loop fastener, or comprises a hook-and-loop fastener, respectively. The hook-and-loop fastener can correspondingly be formed by the first separating or opening means 3', respectively, and the second separating or opening means 3", respectively. Moreover, the hook-and-loop fastener can be configured in the form of (i) a hook tape and piled tape, and/or (ii) a mushroom-head tape and velvet tape and/or (iii) a mushroom-head tape and piled tape, preferably a hook tape and piled tape.

According to yet a further embodiment it can also be provided that the separating or opening installation 3, respectively, is configured in the form of a releasable seam, or comprises a releasable seam, respectively. In this context, the mutually opposite peripheries or peripheral portions 7, respectively, of the protection clothing unit 1 or the protection clothing piece 2, respectively, can be connected by means of a releasable seam. For example, the seam can be selected from the group of chain stitch and string seam. In principle, the configuration of the separating or opening installation 3, respectively, can also be performed by means of adhesive bonding or welding, respectively, or the like.

Opening the releasable seam in question can be performed by pulling the thread, yarn, doubled yarn, or the like, that configures the seam, for example.

According to yet another further embodiment it can moreover be provided that the separating or opening installation 3, respectively, is configured in the form of a cutting or trimming region, respectively, (cutting or trimming areas, respectively). In this context, the cutting or trimming region can be configured in the form of a textile planar material, or comprise such a textile planar material, respectively.

The cutting or trimming region, respectively, can correspondingly be incorporated or integrated, respectively, as a separate portion, or as a separate or independent element, respectively, in the protection clothing unit 1 or the protection clothing piece 2, respectively, in particular by means of stitching or the like.

In particular, the cutting or trimming region, respectively, can be formed or provided, respectively, by way of the protection clothing unit 1 or the protection clothing piece 2, respectively, in particular by way of a specific, in particular textile, region or portion, respectively, of the protection clothing unit 1 or the protection clothing piece 2, respectively, or in particular by way of at least one textile planar material or element 8, 9, respectively, in particular in the form of a splinter protection planar material or element 8, respectively, or of a further textile planar material or element 9, respectively, of the protection clothing unit 1 or the protection clothing piece 2, respectively. In particular, the cutting or trimming region, respectively, can be a direct component part of the protection clothing unit 1 or the protection clothing piece 2, respectively, in particular of at least one textile planar material or element 8, 9 of the protection clothing unit 1 or the protection clothing piece 2, respectively. A seamless configuration or integration, respectively, of the cutting or trimming region, respectively, can correspondingly be present in particular in the protection clothing piece 2.

In as far as the configuration of the separating or opening installation 3, respectively, in the form of a cutting or trimming region, respectively, is concerned, it can thus be provided according to the invention that the cutting or trimming region, respectively, in comparison to the material of the protection clothing unit 1 and/or the protection clothing piece 2 that is contiguous to the cutting and/or trimming region, in particular in comparison to the contiguous textile planar materials and/or elements 8, 9, has a lower cutting or trimming resistance, respectively. In this context, the cutting or trimming resistance, respectively, of the cutting or trimming region, respectively, can be at most 80%, in particular at most 60%, preferably at most 40%, preferably at most 20%, of the cutting and/or trimming resistance of the material that is contiguous to the cutting or trimming region, respectively, in particular of the textile planar materials or elements 8, 9, respectively, that are contiguous to the cutting or trimming region, respectively.

It can in particular be moreover provided that the cutting and/or trimming region in comparison to the material of the protection clothing unit 1 and/or the protection clothing piece 2 that is contiguous to the cutting and/or trimming region, in particular in comparison to the contiguous textile planar materials and/or elements 8, 9, has a lower thickness. In this context, the thickness of the cutting or trimming region, respectively, can be at most 90%, in particular at most 70%, preferably at most 50%, preferably at most 30%, of the thickness of the material that is contiguous to the cutting and/or trimming region, in particular of the textile planar materials and/or elements 8, 9 that are contiguous to the cutting and/or trimming region.

The cutting and/or trimming region can moreover have at least one yarn and/or one doubled yarn and/or one thread having a yarn count that is lower in comparison to the yarn and/or doubled yarn and/or thread of the material of the protection clothing unit 1 and/or the protection clothing piece 2 that is contiguous to the cutting and/or trimming region, in particular in comparison to the yarn and/or doubled yarn and/or thread of the contiguous textile planar materials and/or elements 8, 9. In this context, the yarn count can be at most 80%, in particular at most 60%, preferably at most 40%, preferably at most 20%, of the yarn count of the yarn or double yarn or thread, respectively, of the material that is contiguous to the cutting or trimming region, respectively, in particular of the textile planar materials or elements 8, 9 that are contiguous to the cutting or trimming region, respectively. In particular, the yarn or the doubled yarn or the thread, respectively, of the cutting or trimming region, respectively, in this context can have a yarn count in the range from 5 to 400 dtex, in particular 10 to 300 dtex, preferably 15 to 150 dtex, preferably 20 to 100 dtex, particularly preferably 25 to 45 dtex.

Moreover, the cutting and/or trimming region can have at least one yarn and/or one doubled yarn and/or one thread having a diameter that is lower in comparison to the yarn and/or doubled yarn and/or thread of the material of the protection clothing unit 1 and/or the protection clothing piece 2 that is contiguous to the cutting and/or trimming region, in particular in comparison to the yarn and/or doubled yarn and/or thread of the contiguous textile planar materials and/or elements 8, 9. In this context, the diameter can be at most 80%, in particular at most 60%, preferably at most 40%, preferably at most 20%, of the diameter of the yarn or doubled yarn or thread, respectively, of the material that is contiguous to the cutting or trimming region, respectively, in particular of the textile planar materials or elements 8, 9 that are contiguous to the cutting or trimming region, respectively. Moreover, the yarn can have a diameter in the range from 1 μm to 200 μm, in particular 5 μm to 150 μm, preferably 6 μm to 100 μm, preferably 8 μm to 50 μm.

Furthermore, the cutting and/or trimming region can have at least one yarn and/or one doubled yarn and/or one thread having a tensile strength that is lower in comparison to the yarn and/or doubled yarn and/or thread of the material of the protection clothing unit 1 and/or the protection clothing piece 2 that is contiguous to the cutting and/or trimming region, in particular in comparison to the yarn and/or doubled yarn and/or thread of the contiguous textile planar materials and/or elements 8, 9. In this context, the tensile strength can be at most 80%, in particular at most 60%, preferably at most 40%, preferably at most 20%, of the yarn count of the yarn or doubled yarn or thread of the material that is contiguous to the cutting or trimming region, respectively in particular of the textile planar materials or elements 8, 9 that are contiguous to the cutting or trimming region. In this context, the yarn or the doubled yarn or the thread, respectively, of the cutting or trimming region, respectively, can have a tensile strength in the range from 0.5 N/tex to 6 N/tex, in particular 1 N/tex to 4 N/tex, preferably 1.5 N/tex to 3 N/tex.

In as far as the width of the separation or opening installation 3, respectively, is concerned in general, said width can thus in principle vary in large ranges. However, according to the invention it is preferable for the width of the separating or opening installation 3, respectively, in particular of the cutting or trimming region, respectively, to be as small as possible, in particular so as to at least not substantially compromise the protection function. Moreover, the separating or opening installation 3, respectively, in particular the cutting or trimming region, respectively, should in principle be chosen so as to be so wide that any opening or separating, respectively, in particular by cutting open or the like, that is to be carried out quickly or as safely as possible, respectively, can be performed in the case of an emergency-related opening. In this context, the width of the separating or opening installation 3, respectively, in particular of the cutting or trimming region, respectively, can be in the range from 1 mm to 100 mm, in particular in the range from 2 mm to 50 mm, preferably in the range from 3 mm to 40 mm, preferably in the range from 5 mm to 30 mm. In this respect, a person skilled in the art will always be capable of selecting and tuning the respective width of the separating or opening installation 3, respectively, in particular of the cutting or trimming region, respectively, against the background of the constructive design embodiment of the separating or opening installation 3, respectively, as well as of the protection clothing piece 2 overall.

In the context of the present invention it is generally guaranteed that the separating or opening installation 3, respectively, in particular the cutting or trimming region, respectively, does at least not substantially reduce the protection area of the protection clothing piece 2, in particular with a view to maintaining the protection function provided.

In as far as the cutting or trimming region, respectively is moreover concerned, it also thus applies here that said cutting or trimming region, respectively, is integrated or disposed, respectively, in the protection clothing unit 1 or the protection clothing piece 2, respectively, in such a manner that a rapid release of the wearer from the protection clothing unit 1, or opening or severing, respectively, the protection clothing unit 1, respectively, is enabled in particular in the case of a medical emergency, since the underlying protection clothing pieces 2 can be cut open in the fastest possible manner along the cutting or trimming region, respectively. The separating or opening installation, respectively, configured in the form of a cutting or trimming region, respectively, can in principle run along the connection seams present in the protection clothing piece 2, or can be configured by said connection seams, respectively.

In particular, the cutting or trimming region, respectively, can also be provided by a seam connection of the protection clothing piece 2, or the like.

In as far as the protection clothing unit 1 according to the invention is furthermore concerned, the protection clothing unit 1 or the protection clothing piece 2, respectively, can thus comprise at least one textile planar material or element 8, 9, in particular at least one, in particular textile, splinter protection planar material or element 8 (splinter protection planar element or splinter protection element, respectively). The splinter protection planar materials or elements 8, respectively, in question serve in particular for providing the splinter or fragment protection function, respectively, or the ballistic protection, respectively, of the protection clothing unit 1 according to the invention.

According to a particularly preferred embodiment according to the invention it can be provided herein that the protection clothing unit 1 or the protection clothing piece 2 has mutually dissimilar, in particular textile, splinter protection planar materials or elements 8, respectively, that in the worn state are assigned to different body regions or in the worn state cover different body regions, respectively, said splinter protection planar materials or elements 8, respectively, preferably having a protection function in relation to splinters caused or released, respectively, by detonation or explosion, respectively.

The protection clothing unit 1 or the protection clothing piece 2, respectively, in particular the splinter protection planar material or element 8, respectively, according to the invention can have or be composed of at least one polyethylene having an ultra-high molecular weight (Ultra High Molecular Weight Polyethylene or UHMW-PE, respectively).

In as far as the present invention is thus concerned, a very special material in the form of a polyethylene having an ultra-high molecular weight (Ultra High Molecular Weight Polyethylene or UHMW-PE, respectively) is thus in particular used in a manner corresponding to the protection clothing unit 1 or the protection clothing piece 2, respectively, in particular in a manner corresponding to the splinter protection planar materials or elements 8, specifically in particular in the form of a yarn or a doubled yarn or a thread, respectively, particularly preferably in the form of a yarn, in order for a textile planar structure to be configured. In this context, the applicant in an entirely surprising manner has established that the use of a special material of this type is particularly suitable for use in the context of the present invention. The polyethylene used according to the invention, having an ultra-high molecular weight, in the form of yarns or doubled yarns or threads, respectively, thus has a very high tensile strength as well as high toughness, a high breaking strength or flexural strength, respectively, and a very high E modulus. Moreover, UHMW-PE is resistant to humidity and UV, which according to the invention likewise leads to a high wash resistance being guaranteed, associated with high resistance or durability, respectively, of the ballistic protection function. Moreover, UHMW-PE in physiological terms is of no concern and skin-friendly such that no skin irritations are caused when wearing the protection clothing according to the invention. Furthermore, a very positive resistance to chemicals and an outstanding resistance to bacteria is present.

In particular, it can be provided according to the invention that the protection clothing unit 1 or the protection clothing piece 2, respectively, in particular the splinter protection planar material or element 8, respectively, has or is composed of at least one yarn or one doubled yarn or one thread or one fiber, respectively, preferably at least one filament yarn, based on or in the form of, respectively, at least one polyethylene having an ultra-high molecular weight (Ultra High Molecular Weight Polyethylene or UHMW-PE, respectively). It can in particular be provided that the protection clothing unit 1 or the protection clothing piece 2, respectively, in particular the splinter protection planar material or element 8, respectively, includes the polyethylene having an ultra-high molecular weight in a range from 5% by weight to 100% by weight, in particular 25% by weight to 99% by weight, preferably 50% by weight to 95% by weight, preferably 50% by weight to 90% by weight, in relation to the protection clothing unit 1 or the protection clothing piece 2, respectively, in particular in relation to the textile splinter protection planar material or element 8.

According to a less preferred embodiment according to the invention, it can however in principle also be provided that the protection clothing unit 1 or the protection clothing piece 2, in particular the splinter protection planar material or element 8, has or is composed of at least one yarn or one doubled yarn or one thread or one fiber, respectively, based on, or in the form of, respectively, aramids; polybenzazoles, in particular poly(phenylene-2,6-benzobisoxazole) (PBO); high performance polyethylene (HPPE); high performance polyesters (high-strength polyesters). The aforementioned materials can include quantities in the range from 1% by weight to 100% by weight, in particular 2% by weight to 90% by weight, preferably 3% by weight to 70% by weight, preferably 10% by weight to 50% by weight, in relation to the protection clothing unit 1 or the protection clothing piece 2, respectively, in particular in relation to the textile splinter protection planar material or element 8. In particular, the aforementioned materials can also be used in combination with a material based on UHMW-PE.

According to the invention it can in particular be provided that the protection clothing unit 1 or the protection clothing piece 2, respectively, in particular the splinter protection planar material or element 8, has or is composed of at least one textile knitwear.

In this context, it has proven to be particularly advantageous when the knitwear has a multiplicity of loops, on the one hand, and a multiplicity of at least one binding element that is dissimilar to said loops on the other hand. The use of a textile knitwear herein is in particular associated with the advantage that the resulting planar material, by virtue of the structure of the mass, is elastic, elongatable, pliable, and flexible, which further improves the wear comfort together with a highly accurate design fit, and moreover leads to the protection clothing unit 1, or the corresponding protection clothing pieces 2, respectively, being able to be readily stowed and transported, and to overall outstanding properties in terms of wear physiology being present. Moreover, on this basis, the ballistic properties are furthermore improved, in particular by virtue of the configuration of a fixed (loop) composite of the textile knitwear used according to the invention.

As has been stated above, on account of the configuration of special binding elements, the stability and the ballistic protection function provided by the knitwear herein is thus yet once more improved in a sustainable manner.

In particular, the textile knitwear can be configured in the form of a warp and/or weft-knitted fabric, in particular a warp-knitted fabric or a weft-knitted fabric, respectively, preferably a warp-knitted fabric, or in the form of a knitted fabric, preferably in the form of a knitted fabric. In this context, the textile knitwear, in particular in the form of a knitted fabric, can have a design selected from the group of fringe, tricot, Milanese, satin, plush and atlas. Moreover, the knitwear can have a right/left (R/L), right/right (R/R) or left/left (L/L) loop construction.

Moreover, the binding element can be selected from the group of loop strap, float, weft, inlay, and filler for yarn, preferably loop strap and float. In particular, the binding element herein can be configured in the form of a loop strap and/or a float. As has been stated above, the stability of the material can be furthermore improved on account thereof, associated with a corresponding improvement of the ballistic protection function.

Moreover, the yarn or the doubled yarn or the thread, respectively, in particular the filament yarn, can have a yarn count in the range from 50 to 500 dtex, in particular 75 to 450 dtex, preferably 100 to 400 dtex, preferably 110 to 300 dtex.

Moreover, the yarn or the doubled yarn or the thread, respectively, in particular the filament yarn, can have a diameter in the range from 4 μm to 250 μm, in particular 6 μm to 200 μm, preferably 8 μm to 150 μm, preferably 10 μm to 100 μm.

In particular, the yarn or the doubled yarn or the thread, respectively, in particular the filament yarn, can have a tensile strength in the range from 2 N/tex to 8 N/tex, in particular 2.5 N/tex to 6 N/tex, preferably 3 N/tex to 5 N/tex.

Moreover, the yarn or the doubled yarn or the thread, respectively, in particular the filament yarn, can have an elasticity modulus in the range from 50 N/tex to 300 N/tex, in particular 75 N/tex to 250 N/tex, preferably 100 N/tex to 200 N/tex. The yarn or the doubled yarn, respectively, and/or the thread, in particular the filament yarn, can likewise have an elongation at break in the range from 0.5% to 10%, in particular 1% to 8%, preferably 1.5% to 6%, preferably 2% to 5%, particularly preferably 3% to 4%.

Moreover, the yarn or the doubled yarn or the thread, respectively, in particular the filament yarn, can have a density in the range from 800 kg/m$^3$ to 1200 kg/m$^3$, in particular 800 kg/m$^3$ to 1200 kg/m$^3$, preferably 850 kg/m$^3$ to 1100 kg/m$^3$, preferably 900 kg/m$^3$ to 1050 kg/m$^3$, particularly preferably 950 kg/m$^3$ to 1000 kg/m$^3$.

In particular, the yarn or the doubled yarn or the thread, respectively, in particular the filament yarn, can have a crystallinity in the range from 70% to 95%, in particular 75% to 90%, preferably 80% to 85%.

It can likewise be provided according to the invention that the yarn or the doubled yarn or the thread, respectively, in particular the filament yarn, has a crystallinity of at most 95%, in particular at most 90%, preferably at most 85%.

It can moreover be provided according to the invention that the protection clothing unit 1 or the protection clothing piece 2, respectively, in particular the splinter protection planar material or element 8, respectively, preferably the knitwear, is equipped with at least one further material, in particular yarn or doubled yarn or thread, respectively, that is dissimilar to polyethylene with an ultra-high molecular weight (UHMW-PE).

In this context, the yarn or the doubled yarn or the thread, respectively, in particular the filament yarn, can be equipped with at least one further material, in particular filament, that is dissimilar to polyethylene having an ultra-high molecular weight (UHMW-PE), in particular for configuring antimicrobial or biostatic, respectively, elastic, hydrophilic, fire-resistant or flame-resistant, respectively, properties.

In this context, the material, in particular the yarn or the doubled yarn or the thread, respectively, or the filament, that is dissimilar to polyethylene having an ultra-high molecular weight (UHMW-PE) can be selected from the group of natural substances and synthetic substances, in particular silk, cotton, wool, linen, elastane, modacrylic, aramid, in particular meta-aramid, and mixtures thereof.

In particular, the content of material, in particular in the form of the yarn and/or doubled yarn or thread, respectively, or filament, that is dissimilar to polyethylene having an ultra-high molecular weight (UHMW-PE) can be in the range from 1% by weight to 60% by weight, in particular 2% by weight to 55% by weight, preferably 5% by weight to 50% by weight, preferably 10% by weight to 40% by weight, in relation to the protection clothing unit 1 or the protection clothing piece 2, in particular in relation to the splinter protection planar material or element 8, respectively, preferably the knitwear.

Moreover, the knitwear can be configured as a two-dimensional textile planar material. The textile knitwear can in particular have an area weight in the range from 75 g/m$^2$ to 700 g/m$^2$, in particular 100 g/m$^2$ to 600 g/m$^2$, preferably 125 g/m$^2$ to 500 g/m$^2$, preferably 150 g/m$^2$ to 400 g/m$^2$.

In particular, the knitwear can be configured so as to be gas-permeable, in particular air-permeable. Moreover, the textile knitwear, determined according to DIN ISO 9237 can have an air-permeability of at least 1000 l/m$^2$ min, preferably at least 2000 l/m$^2$ min, preferably at least 3000 l/m$^2$ min, particularly preferably at least 4000 l/m$^2$ min, most particularly preferably at least 5000 l/m$^2$·min.

Moreover, the knitwear can be configured so as to be water-vapor-permeable. In particular, the textile knitwear can have a water vapor transmission at 20° C. of at least 20 l/m$^2$ per 24 h, in particular 30 l/m$^2$ per 24 h, preferably at least 40 l/m$^2$ per 24 h, particularly preferably at least 50 l/m$^2$ per 24 h.

In particular, the knitwear can have a water vapor volume resistance $R_t$ at stationary conditions at 20° C. of at most 20

($m^2$·Pascal)/Watt, in particular at most 15 ($m^2$·Pascal)/Watt, preferably at most 10 ($m^2$·Pascal)/Watt, particularly preferably at most 5 ($m^2$·Pascal)/Watt.

The water vapor transmission can in particular be measured according to the "Inverted Cup Method" according to ASTM E 96 and at 20° C. (for further details for measuring the Water Vapor Transmission [WVT] also refer to McCullough et al. "*A comparison of standard methods for measuring water vapor permeability of fabrics" in Meas. Sci. Technol.* [*Measurements Science and Technology*] 14, 1402-1408, August 2003). A particularly high level of wear comfort is guaranteed on account thereof since body perspiration can be transported away in an effective manner.

The water vapor volume resistance $R_t$ can in particular be measured according to DIN EN 31 092:1993, or according to the equivalent international standard ISO 11092 of February 1994 ("Textilien—physiologische Wirkungen, Messung des Wärme—und Wasserdampfdurchgangswiderstandes under stationären Bedingungen (sweating guarded-hotplate test)") ["Textiles—physiological effects, measuring the heat and water vapor volume resistance under stationary conditions [sweating guarded-hotplate test]"].

Moreover, the knitwear can have a thickness in the range from 0.05 mm to 50 mm, in particular 0.1 mm to 25 mm, preferably 0.2 mm to 15 mm, preferably 0.3 mm to 10 mm, particularly preferably 0.4 mm to 5 mm, most particularly preferably 0.5 mm to 3 mm. It can moreover be provided according to the invention that the knitwear on the (primary) area that in the worn state faces the wearer, or on the internal area of the textile knitwear, respectively, or on the (primary) area that in the worn state faces away from the wearer, or on the on the external area, respectively, has rib-shaped elevations, preferably longitudinal ribs. It can in particular be provided that the rib-shaped elevations, in particular the longitudinal ribs, run and/or are disposed so as to be at least substantially rectilinear or mutually parallel, respectively.

It can moreover be provided according to the invention that the splinter protection planar material and/or element 8 has or is composed of a tier of the textile knitwear. In particular, the splinter protection planar material or element 8, respectively, can have a plurality of tiers of the textile knitwear, in particular as defined above, in particular have two, three, four, five, six, seven, eight or more tiers of the textile knitwear. The respective tiers of the textile knitwear herein can be disposed in the shape of a stack and/or so as to be in mutually parallel planes.

In this context, the tiers of the textile knitwear can be connected, in particular stitched, to one another, in particular peripherally and/or in a linear manner along the (primary) areas of the respective tiers.

In this context, at least two in particular successive tiers of the textile knitwear, in relation to the (primary) areas of the respective tiers, or in relation to the alignment of the underlying loops of the knitwear, respectively, or in relation to the rib-shaped elevations of the respective tiers of the knitwear, respectively, can moreover be aligned or disposed so as to be mutually rotated, in particular at an angle in the range from 45° to 90°, preferably at an angle of approximately 90°.

According to an embodiment according to the invention it can in particular be provided that the splinter protection planar material or element 8, as is illustrated in FIG. 1 as well as FIG. 2, is in particular a fixed component part of the protection clothing unit 1 or the protection clothing piece 2, respectively. In this context, the splinter protection planar material or element 8, respectively, can be fixedly or durably (permanently), respectively, connected to the protection clothing unit 1 or the protection clothing piece 2. Correspondingly the connection can be performed, for example, by means of stitching, tacking, welding, seamless adhesive bonding, or the like.

In particular, a plurality of splinter protection elements can configure an in particular single-tier or single-layer, respectively, (basic) area of the protection clothing unit 1 of the protection clothing piece 2, or be a component part of a (basic) area of this type.

According to a further embodiment it can moreover be provided that the splinter protection planar material or element 8, respectively, is connected to the protection clothing unit 1 or the protection clothing piece 2, respectively, in a releasable or removable or detachable manner, respectively. It can in particular be provided that the splinter protection planar material or element 8, respectively, is capable of being introduced into introduction or receptacle devices, in particular introduction or receptacle pockets, of the protection clothing unit 1.

In as far as the arrangement of the splinter protection planar material or element 8, respectively, is concerned, the following procedure can thus in particular be correspondingly followed:

According to the invention it can in particular arise that the splinter protection planar materials or elements 8, respectively, in a mutually independent manner, in the worn state extend across the region of the thigh, in particular the front, inner or rear, thigh, preferably the front or inner thigh, respectively; the loin; the genitals; the anal and/or perineal region; the lower leg, in particular the front, inner or rear, respectively, lower leg, preferably the front or inner lower leg, respectively; the knee or the popliteal fossa; the lower abdomen or the bladder and urinal tract, respectively; the lower back or the renal pelvis, respectively; the torso, in particular the lateral or rear torso, respectively; the upper or lower arm, respectively; the antecubital area or the elbow; the shoulder; the neck; the in particular lower facial part; the hand, in particular the back of the hand; or the wrist, respectively, or at least partially cover the aforementioned regions in the worn state of the protection clothing unit 1 or the protection clothing piece 2, or are disposed in the aforementioned regions in the worn state.

It can in particular be provided according to the invention that the protection clothing unit 1 or the protection clothing piece 2, respectively, in particular the splinter protection planar material or element 8, respectively, has a splinter or ballistic protection rating $V_{50}$, determined according to STANAG 2920, of at least 175 m/s, in particular at least 195 m/s, preferably at least 220 m/s, preferably at least 245 m/s, particularly preferably at least 270 m/s, most particularly preferably at least 295 m/s, furthermore particularly preferably at least 320 m/s, even furthermore preferably at least 345 m/s.

It can in particular be provided that the protection clothing unit 1 or the protection clothing piece 2, respectively, in particular the splinter protection planar material or element 8, respectively, has ballistic protection rating $V_{50}$, determined according to STANAG 2920, in the range from 175 m/s to 795 m/s, in particular 195 m/s to 745 m/s, preferably 220 m/s to 695 m/s, preferably 245 m/s to 645 m/s, particularly preferably 270 m/s to 595 m/s, most particularly preferably 295 m/s to 545 m/s, even furthermore preferably 320 m/s to 520 m/s, yet again furthermore preferably 345 m/s to 520 m/s.

The ballistic protection ratings $V_{50}$ stated according to the invention, determined according to STANAG 2920, herein relate in particular to a determination while using projectiles in the form of RCCs (right circular cylinders) having a projectile weight of 0.13 g. The ballistic protection ratings $V_{50}$ stated according to STANAG 2920 are determined in particular at a temperature of (20±2) ° C. and in particular at a relative air humidity of (65±4) %.

In this context, the high protection properties of the protection clothing unit according to the invention are guaranteed by way of the specified high $V_{50}$ rating according to STANAG 2920 of at least 180 m/s according to the invention.

The $V_{50}$ rating herein relates in particular to the velocity (m/s) at which, while using a defined projectile and a selected (test) material, a probability of a perforation or penetration, respectively, of the material caused by the projectile is 0.5 or 50%, respectively (1 being equal to the maximum probability). In terms of further explanations, reference can be made to the respective standard according to STANAG 2920.

In as far as the protection clothing unit according to the invention is furthermore concerned, said protection clothing unit, as stated above, thus has a high protection function in relation to the effect of splinters or fragments, respectively, released in particular by explosion or detonation, respectively.

The protection clothing unit 1 or the protection clothing piece 2, respectively, can furthermore have at least one further textile planar material or element 9. In this context, the further textile planar material or element 9, respectively, conjointly with the at least one splinter protection planar material or element 8, respectively, can configure an in particular single-tier or single-layer, respectively, (basic) area of the protection clothing unit 1 or the protection clothing piece 2, respectively. Moreover, the further textile planar material and/or element 9, in particular can in each case be connected, in particular stitched, peripherally, preferably so as to be peripherally overlapping, to the splinter protection planar material and/or element 8.

In particular, the further textile planar material or element 9, respectively, can be configured so as to be gas-permeable, in particular air-permeable, or water-vapor-permeable, respectively.

Moreover, the further textile planar material or element 9, respectively, can be configured as a woven fabric, warp and/or weft knitted fabric, knitted fabric, cross-laid structure, or textile composite material, in particular as a warp and/or weft knitted fabric or knitted fabric.

In this context, it can thus be in particular provided that both the textile planar material or element 9, respectively, as well as the textile splinter protection planar material or element 8, respectively, as mentioned above, are configured as a warp and/or weft knitted fabric or knitted fabric, in particular wherein the respective protection clothing piece 2 overall can be configured in the form of a warp and/or weft knitted fabric or knitted fabric.

Moreover, the further textile planar material can have an area weight in the range from 50 g/m$^2$ to 800 g/m$^2$, in particular 60 g/m$^2$ to 500 g/m$^2$, preferably 70 g/m$^2$ to 300 g/m$^2$, preferably 90 g/m$^2$ to 150 g/m$^2$.

The further textile planar material and/or element 9 can likewise be configured so as to be elastic and/or reversibly elongatable. Moreover, the further textile planar material 9 can have at least one elastic and/or reversibly elongatable yarn and/or fiber and/or at least one elastic and/or reversibly elongatable doubled yarn and/or thread, in particular based on a synthetic polymer material, in particular based on a block copolymer having the component parts of polyurethane and polyethylene glycol. The further textile planar material or element 9, respectively, can correspondingly contain the elastic and/or reversibly elongatable type of yarn, doubled yarn, thread and/or fiber in a quantity in the range from 5 to 30% by weight, in particular 7 to 25% by weight, preferably 8 to 20% by weight, in relation to the textile planar material and/or element 9.

The further textile planar material or element 9, respectively, can likewise be configured as a mesh product and/or a mesh material. Hole sizes in the range from 0.1 mm to 10 mm, in particular 0.2 mm to 8 mm, preferably 0.5 mm to 4 mm, preferably 1 mm to 3 mm, can correspondingly be implemented.

Moreover, the further textile planar material or element 9, respectively, can moreover have at least one further type of yarn, doubled yarn, thread and/or fiber. The further type of yarn, doubled yarn, thread and/or fiber can correspondingly be selected from the group of natural substances and synthetic substances, preferably be selected from the group of cotton; wool; linen; polyesters; polyolefins; polyvinyl chloride; polyvinylidene chloride; acetate; triacetate; polyacrylic; polyamide; polyvinyl alcohol; polyurethanes; polyvinyl esters, and the mixtures thereof.

In particular the wear comfort as well as the design fit of the protection clothing unit 1 according to the invention, or the underlying protection clothing piece 2, respectively, can be furthermore improved by the targeted use of at least one further textile planar material or element 9, respectively. In particular, the further textile planar materials or elements 9 can be connected to the textile splinter protection planar materials or elements 8, respectively, as stated above, in particular so as to configure a (basic) area, in particular as has been stated above with reference to the textile splinter protection planar material or element 8, respectively.

It can furthermore also be provided according to the invention that the protection clothing unit 1 or the protection clothing piece 2, respectively, has at least one cover planar material, preferably in the form of a textile planar material, in particular wherein the cover planar material in the worn state is disposed on the side facing away from the wearer.

In this context, the cover planar material can be configured as a woven fabric, warp and/or weft knitted fabric, knitted fabric, cross-laid structure, or textile composite material, in particular as a woven fabric, warp and/or weft knitted fabric, or knitted fabric. Moreover, the cover planar material can have an area weight in the range from 50 g/m$^2$ to 500 g/m$^2$, in particular 75 g/m$^2$ to 300 g/m$^2$, preferably 100 g/m$^2$ to 300 g/m$^2$. Furthermore, the cover planar material can be configured so as to be gas-permeable, in particular air-permeable, and/or water-vapor-permeable.

Moreover, the cover planar material can be configured so as to be fire resistant and/or flame resistant. In particular, the cover planar material can have at least one fire-resistant and/or flame-resistant material, in particular in the form or as a component part of a yarn and/or doubled yarn and/or thread, preferably filament yarn, in particular wherein the fire-resistant and/or flame-resistant material is at least one aramid, in particular meta-aramid, and/or in particular wherein the content of fire-resistant and/or flame-resistant material is in the range from 1% by weight to 100% by weight, in particular 2% by weight to 90% by weight, preferably 5% by weight to 80% by weight, preferably 10% by weight to 60% by weight, in relation to the cover planar material.

On account thereof, the protection clothing unit according to the invention can be equipped in a purpose-related manner with further functional properties.

In order for the protection clothing unit 1 according to the invention to be configured, it can moreover be provided that the protection clothing unit 1 is additionally impinged and/or equipped with an adsorbent that adsorbs chemical poison and/or warfare agents, in particular a material based on active carbon, preferably in the form of active carbon particles in granular form ("coal granules") or spherical form ("coal spheres"). To this end, the adsorbent can be fixed to the protection clothing unit 1 and/or the protection clothing piece 2 and/or the textile planar materials 8, 9 and/or the cover material or element 11, respectively, by means of an adhesive that is in particular applied discontinuously, preferably in a punctiform manner.

The mean diameter of the adsorbent particles, in particular the active carbon particles, is preferably 0.01 to 2 mm, preferably 0.05 to 1 mm, preferably 0.1 to 0.5 mm. The corresponding particle sizes can in particular be determined based on the method according to ASTM D2862-97/04. Moreover, the aforementioned sizes can be determined using determination methods based on a sieve analysis, based on x-ray diffraction, laser diffraction, or the like. The respective determination methods are well known to a person skilled in the art per se such that no further explanations are required in this context.

According to the invention it has furthermore proven advantageous when the adsorbent particles, in particular the active carbon particles, are used in a quantity in the range from 40 to 250 g/m$^2$, in particular 50 to 180 g/m$^2$, preferably 55 to 130 g/m$^2$.

In as far as the active carbon used according to the invention is moreover concerned, said active carbon can thus be generally obtainable by carbonization and subsequent activation of a synthetic and/or initial material not based on natural substances, in particular based on organic polymers. In the context of the present invention it has proven particularly advantageous when an active carbon based on a very special initial material is used according to the invention. According to a particularly preferred embodiment, the active carbon used according to the invention can thus be obtained from an initial material based on organic polymers, in particular based on sulfonated organic polymers, preferably based on divinyl benzene cross-linked polystyrene, preferably based on styrene/divinyl benzene-copolymers.

In as far as the active carbon particularly preferably used according to the invention is concerned, said active carbon being obtained by carbonization and subsequent activation of the initial material based on organic polymers, it can thus be provided according to the invention that the content of divinyl benzene in the initial material is in the range from 1% by weight to 20% by weight, in particular 1% by weight to 15% by weight, preferably 1.5% by weight to 12.5% by weight, preferably 2% by weight to 10% by weight, in relation to the initial material.

In this context it can be moreover provided according to the invention that the initial material is an in particular ion exchange resin containing sulfonated and/or sulfonic acid groups, in particular from the gel type.

It can in particular be provided according to the invention that a polymer-based spherical active carbon (PBSAC) is used active carbon. The active carbon can in particular be a polymer-based spherical active carbon (PBSAC).

The active carbon used herein can in principle be obtained by methods known in the prior art. For this purpose, spherical sulfonated organic polymers, in particular based on divinyl benzene cross-linked polystyrene, are in particular carbonized and subsequently activated so as to form the respective active carbon, in particular as has been stated above. For further corresponding details, reference can be made, for example, to the publications DE 43 28 219 A1, DE 43 04 026 A1, DE 196 00 237 A1, as well as EP 1 918 022 A1, or to parallel U.S. Pat. No. 7,737,038 B2 which is part of the same patent family, the complete respective content referred to of said publications hereby being incorporated.

Active carbons used in the context of the present invention are generally commercially available or customary, respectively. In particular, active carbons which are marketed, for example, by Blücher GmbH, Erkrath, Germany, or by AdsorTech GmbH, Premnitz, Germany, can be used.

In as far as the active carbon per se used or implemented, respectively, in the context of the present invention is concerned, the details pertaining to parameters listed herein in terms of the underlying active carbon are thus determined using standardized or explicitly stated determination methods or by determination methods known per se to a person skilled in the art. In particular, the details pertaining to parameters referring to the characterization of the porosity of the distribution of pore size and other adsorption properties arise generally in each case from the respective nitrogen sorption isotherms of the respective active carbon, or the products measured, respectively. Moreover, the distribution of pores, in particular also with a view to the content of micropores in relation to the total pore volume, can be determined based on DIN 66135-1.

In the context of the present invention it has moreover proven advantageous when the active carbon used according to the invention has a furthermore specified total pore volume, in particular a total pore volume according to Gurvich, as is stated hereunder.

It can thus be provided according to the invention that the active carbon has a total pore volume, in particular a total pore volume according to Gurvich, in the range from 0.3 cm$^3$/g to 3.8 cm$^3$/g, in particular 0.4 cm$^3$/g to 3.5 cm$^3$/g, preferably 0.5 cm$^3$/g to 3 cm$^3$/g, particularly preferably 0.6 cm$^3$/g to 2.5 cm$^3$/g, most particularly preferably 0.7 cm$^3$/g to 2 cm$^3$/g.

In as far as the determination of the total pore volume according to Gurvich is concerned, this is thus a measuring/determination method well known to a person skilled in the art in this field per se. For further details relating to the determination of the total pore volume according to Gurvich, reference can be made, for example to L. Gurvich (1915), *J. Phys. Chem. Soc. Russ.* 47, 805, as well as to S. Lowell et al., Characterization of Porous Solids and Powders: Surface Area Pore *Size and Density, Kluwer Academic Publishers, Article Technology Series*, pages 111 ff. In particular, the pore volume of the active carbon can be determined based on the Gurvich rule, according to the formula $V_P=W_a/\rho_I$, wherein $W_a$ is the adsorbed quantity of an underlying adsorbent, and $\rho_I$ is the density of the adsorbent used (cf. also formula (8.20) according to page 111, chapter 8.4.) of S. Lowell et al.).

It can in particular be provided according to the invention that at least 65%, in particular at least 70%, preferably at least 75%, preferably at least 80%, of the total pore volume, in particular of the total pore volume according to Gurvich, of the active carbon are formed by pores having pore diameters of at most 50 nm, in particular by micropores and/or mesopores.

It can in particular be likewise provided according to the invention that 50% to 95%, in particular 60% to 90%, preferably 70% to 85%, of the total pore volume, in particular of the total pore volume according to Gurvich, of the active carbon are formed by pores having pore diameters of at most 50 nm, in particular by micropores and/or mesopores.

It can in particular be provided according to the invention that 1% to 60%, in particular 5% to 50%, preferably 10% to 40%, preferably 15% to 35%, of the total pore volume, in particular of the total pore volume according to Gurvich, of the active carbon are formed by pores having pore diameters of more than 2 nm, in particular by mesopores and/or macropores.

In particular, the active carbon can has a pore volume, in particular a micropore volume according to Carbon Black, formed by pores having pore diameters of at most 2 nm (that is to say ≤2 nm), in the range from 0.05 $cm^3/g$ to 2.5 $cm^3/g$, in particular 0.15 $cm^3/g$ to 2 $cm^3/g$, preferably 0.3 $cm^3/g$ to 1.5 $cm^3/g$, in particular wherein 15% to 98%, in particular 25% to 95%, preferably 35% to 90%, of the total pore volume of the active carbon are formed by pores having pore diameters of at most 2 nm, in particular by micropores.

The determination method according to Carbon Black is known per se to a person skilled in the art, wherein for further details for determining the pore surface and the pore volume according to Carbon Black reference can moreover be made, for example, to R. W. Magee, *Evaluation of the External Surface Area of Carbon Black by Nitrogen Adsorption, Presented at the Meeting of the Rubber Division of the American Chem. Soc.*, October 1994, referred to, for example, in: *Quantachrome Instruments, AUTOSORB*-1, *AS*1 *Win Version* 1.50, *Operating Manual, OM,* 05061, *Quantachrome Instruments* 2004, Florida, USA, pages 71 ff. The corresponding evaluation can in particular be performed by means of the t-plot method.

Moreover, the active carbon can have a specific BET surface in the range from 600 $m^2/g$ to 4000 $m^2/g$, in particular 800 $m^2/g$ to 3500 $m^2/g$, preferably 1000 $m^2/g$ to 3000 $m^2/g$, particularly preferably 1200 $m^2/g$ to 2750 $m^2/g$, most particularly preferably 1300 $m^2/g$ to 2500 $m^2/g$.

The determination of the specific surface according to BET per se is known in principle to a person skilled in the art such that no further details need to be explained in this context. All of the BET surface details refer to the determination according to ASTM D6556-04. In the context of the present invention, the so-called MultiPoint-BET determination method (MP-BET) is generally applied in a partial pressure range $\rho/\rho_0$ from 0.05 to 0.1, in as far as not otherwise expressly stated for determining the BET surface.

For further details pertaining to the determination of the BET surface or to the BET method, respectively, reference can be made to the aforementioned ASTM D6556-04 and to Römpp Chemielexikon, 10. Auflage, Georg Thieme Verlag, Stuttgart/New York, Stichwort: "BET-Methode" (Römpp Chemical Dictionary, 10th edition, Georg Thieme Publications, Stuttgart/New York, keyword "BET method") including the literature reference therein, and to Winnacker-Küchler (3rd edition), volume 7, pages 93 ff., as well as to Z. Anal. Chem. 238, pages 187 to 193 (1968).

In the context of the present invention, the term "micropores" refers to such pores having pore diameters of less than 2 nm, whereas the term "mesopores" refers to such pores having pore diameters in the range from 2 nm (that is to say including 2 nm) to 50 nm inclusive, and the term "macropores" refers to such pores having pore diameters of more than 50 nm (that is to say >50 nm).

The active carbon can in particular have a surface formed by pores having pore diameters of at most 2 nm, in particular by micropores, in the range from 400 to 3500 $m^2/g$, in particular 500 to 3000 $m^2/g$, preferably 600 to 2500 $m^2/g$, preferably 700 to 2000 $m^2/g$.

The active carbon can in particular have a surface formed by pores having pore diameters in the range from 2 nm to 50 nm, in particular by mesopores, in the range from 200 to 2000 $m^2/g$, in particular 300 to 1900 $m^2/g$, preferably 400 to 1800 $m^2/g$, preferably 500 to 1700 $m^2/g$.

The active carbon can in particular have a mean pore diameter in the range from 0.1 nm to 55 nm, in particular 0.2 nm to 50 nm, preferably 0.5 nm to 45 nm, preferably 1 nm to 40 nm.

On account of the purpose-related use of an adsorption material, in particular in the form of active carbon, the protection clothing unit 1 according to the invention, beyond the splinter protection provided according to the invention, can be provided with adsorptive properties, in particular with a view to the adsorption of biological and/or a chemical poison or warfare agents, respectively, such that on account thereof, overall a protection clothing unit 1 having multiple protection (splinter protection and protection in relation to poison or warfare agents, respectively) is provided.

In as far as the splinter protection planar materials or elements 8, respectively, or the textile knitwear per se, is concerned, said splinter protection planar materials or elements 8, respectively, or said textile knitwear, respectively, having the texting knitwear or being formed therefrom, thus have/has further positive properties which contribute toward both the wear comfort as well as toward providing an effective splinter protection function. The splinter protection planar materials or elements 8, respectively, or the corresponding textile knitwears, respectively, thus overall have hydrophilic properties which according to the so-called TEGEWA test can be awarded with the mark 5 (having a marking scale from 1=lowest hydrophilicity to 6=highest hydrophilicity). Consequently, the materials are capable of receiving or transporting away with high efficiency, respectively, body perspiration, specifically without feeling moist even when worn over a long period. Moreover, the underlying materials are antimicrobial or biostatic, respectively, according to ASTM E-2149-C and perspiration-resistant according to DIN EN ISO 105-E04. Moreover, the materials are at least substantially inert in relation to ammonia (urine). Furthermore, the materials used according to the invention have a high resistance to washing, wherein the material is not notably compromised even after 20 laundry cycles at a temperature of 60° C. In this context, the materials also have short drying phases and are moreover certified according to the ÖKO-TEX label (product category II, i.e. products having direct skin contact). Moreover, the materials overall are temperature-resistant and thermally stable, respectively, wherein the material properties are not persistently compromised even after being stored at 70° C. for 24 hours.

A further subject matter of the present invention, according to a further aspect of the present invention, is moreover the use of the protection clothing unit according to the invention, in particular the textile protection clothing unit according to the invention, in particular as defined above, for providing a splinter and/or fragment protection and/or a ballistic protection function, preferably a protection function in relation to splinters and/or fragments caused and/or released by detonation and/or explosion, and/or for minimizing and/or preventing the release and/or creation of secondary splinters and/or secondary fragments caused by the influence of an explosion and/or under a ballistic effect, preferably while hit by primary splinters and/or primary fragments, and emanating from the protection clothing unit per se.

Finally, a further subject matter of the present invention, according to a further aspect of the present invention, is also the separating or opening installation 3, respectively, according to the invention, in particular as defined above, in particular for use in a protection clothing unit 1 and/or a protection clothing piece 2, in particular for the at least partial and/or portion-wise opening of the protection clothing unit 1 and/or the protection clothing piece 2, preferably for the purpose of an in particular emergency-related and/or accelerated undressing of a wearer of the protection clothing unit 1 and/or the protection clothing piece 2, and/or for the purpose of an in particular emergency-related and/or accelerated removal of the protection clothing unit 1 and/or the protection clothing piece 2, wherein the separating and/or opening installation 3 does at least not substantially have any components and/or component parts which release and/or configure secondary splinters and/or secondary fragments.

Further design embodiments, variants, variations, modifications, particularities, and advantages of the present invention can be readily identified and implemented by a person skilled in the art when reading the description, without thereby departing from the scope of the present invention.

LIST OF REFERENCE SIGNS

1 Protection clothing unit
2 Protection clothing piece
3 Separating and/or opening installation
3' First receptacle and/or opening means
3" Second receptacle and/or opening means
4 Opening
5 Connection and/or receptacle element
6 Closure and/or opening element
7 Periphery
8 Textile planar element in the form of a splinter protection planar material and/or element
9 Textile planar material in the form of a further textile planar material and/or element
10 Waistband
11 Cover material and/or element
12 Securing and/or fixing means

The invention claimed is:

1. A textile protection clothing unit providing a ballistic protection function including splinter protection and fragment protection in relation to splinters and fragments which are caused by explosion, wherein the protection clothing unit is composed of at least one textile protection clothing piece having a protection function in relation to splinters or fragments that are caused by explosion, and wherein the protection clothing unit is configured in such a manner that the protection clothing unit, under an influence of an explosion or under a ballistic effect, while being hit by primary splinters or primary fragments, does not release or configure any secondary splinters or secondary fragments or does not comprise any components or component parts which release or configure secondary splinters or secondary fragments;

wherein the at least one protection clothing piece is configured in such a manner that the at least one protection clothing piece, under an influence of an explosion or under a ballistic effect, while being hit by primary splinters or primary fragments, does not release or configure any secondary splinters or secondary fragments at least in portions or regions of the at least one protection clothing piece or does not comprise any components or component parts which release or configure secondary splinters or secondary fragments;

wherein the at least one protection clothing piece comprises at least one opening device for at least partial opening of the at least one protection clothing piece, wherein the at least one opening device does not comprise any components or component parts which release or configure secondary splinters or secondary fragments and wherein the at least one opening device is configured such as to be optically or visually dissimilar to and distinguishable from the at least one protection clothing piece, wherein the at least one textile protection clothing piece and the at least one opening device do not have any components or component parts selected from metal or wood or hard plastics material or glass or ceramics, wherein the at least one opening device comprises at least one first opening means and at least one second opening means, wherein the at least one first opening means and the at least one second opening means interact for providing a closure or connection state of the at least one opening device, wherein the at least one first opening means and the at least one second opening means each comprise a multiplicity of connection and receptacle elements for receiving and guiding at least one closure and opening element, wherein the connection and receptacle elements are each configured in a form of hollow elements and wherein the connection and receptacle elements are selected from a group of tubular segments including sleeves, eyelets, and loop bands, and wherein the connection and receptacle elements each are composed of at least one material configured so as to be flexible and resilient, wherein said material of the connection and receptacle elements is selected from a group of soft plastics materials, rubber, natural rubbers, silicones and combinations thereof, and wherein the at least one closure and opening element is configured so as to connect the at least one first opening means to the at least one second opening means and is composed of a material configured so as to be flexible or flexural, wherein the material of the at least one closure and opening element is selected from a group of soft plastics materials, rubber, natural rubbers, silicones, textile materials and combinations thereof and wherein the at least one closure and opening element is selected from the group consisting of a thread, a yarn, a rope, and a cord;

wherein, in a closed state of the at least one opening device, the connection and receptacle elements of the at least one first opening means are, by means of the at least one closure and opening element, interconnected to or unified with the connection and receptacle elements of the at least one second opening means in an alternating manner to form a continuous tubular structure with the at least one closure and opening element substantially enclosed therein; and wherein the at least one protection clothing piece comprises at least one splinter-protection planar textile material or element comprising or being composed of at least one polyethylene having an ultra-high molecular weight (UHMW-PE).

2. The textile protection clothing unit as claimed in claim 1, wherein the portions or regions of the at least one protection clothing piece which do not release or configure any secondary splinters or secondary fragments, in the worn or use state of the at least one protection clothing piece, are assigned to body portions having an increased risk of injury or having vital functions or organs or cover said body portions, wherein the body portions are selected from a group of i) lower extremities; ii) genitals as well as internal sexual organs; iii) bladder and urogenital tract; iv) perineal and anal region; v) lower abdomen comprising intestine, kidneys, spleen and liver; vi) lateral torso with parts of the lung lobes; vii) rear torso in the renal pelvis region and the spine; viii) upper extremities and shoulder region; and ix) neck and lower facial part.

3. The textile protection clothing unit as claimed in claim 1, wherein the at least one protection clothing piece is configured in such a manner that the at least one protection clothing piece, under an influence of an explosion or under a ballistic effect, while being hit by primary splinters or primary fragments, does not release or configure any secondary splinters or secondary fragments across an entire area of the at least one protection clothing piece or does not comprise across the entire area of the at least one protection clothing piece, any components or component parts which release or configure secondary splinters or secondary fragments.

4. The textile protection clothing unit as claimed in claim 1, wherein the protection clothing unit is configured as at least one of upper wear and underwear.

5. The textile protection clothing unit as claimed in claim 1, wherein the protection clothing unit is configured so as to be in multiple parts.

6. The textile protection clothing unit as claimed in claim 1, wherein the protection clothing unit has or is composed of at least one protection clothing piece selected from a group of underpants, undershirts, pants, pullover-pants, overshirts, jackets, pullover-jackets, ponchos, overalls, socks, pullover shoes, gloves, collars, tubular wear, covers, hoods, hats, arm warmers, leg warmers and the combinations thereof.

7. The textile protection clothing unit as claimed in claim 1, wherein the protection clothing unit comprises at least two protection clothing pieces, wherein the at least two protection clothing pieces are configured so as to be connectible to one another or to a different portion of the protection clothing unit.

8. The textile protection clothing unit as claimed in claim 1, wherein the protection clothing unit is configured as at least one of upper wear and underwear and additionally comprises at least one further protection clothing piece configured as one of a head protection, a face protection, a neck protection, a shoulder protection, an arm protection, a hand protection, a foot protection, a body protection, a torso protection, a genital protection, an anal protection and a leg protection.

9. The textile protection clothing unit as claimed in claim 1, wherein the at least one opening device is configured in such a manner that the at least one opening device, under an influence of an explosion or under a ballistic effect, while hit by primary splinters or primary fragments, does not release or configure any secondary splinters or secondary fragments composed of a non-textile material.

10. The textile protection clothing unit as claimed in claim 1, wherein the at least one opening device does not comprise any non-textile components nor any component parts which, under an influence of an explosion or under a ballistic effect, while hit by primary splinters or primary fragments, release secondary splinters or secondary fragments.

11. The textile protection clothing unit as claimed in claim 1, wherein the protection clothing unit is capable of being opened or separated at least in portions along the at least one opening device.

12. The textile protection clothing unit as claimed in claim 1, wherein the at least one opening device is configured in such a manner that the protection clothing unit is capable of being opened or separated in a longitudinal direction.

13. The textile protection clothing unit as claimed in claim 1, wherein the at least one opening device is disposed along predefined cutting or seam regions of the protection clothing unit.

14. The textile protection clothing unit as claimed in claim 1, wherein the at least one opening device is, at least in portions, covered or overlapped by a textile cover material or element.

15. The textile protection clothing unit as claimed in claim 1, wherein the at least one opening device is configured so as to be optically or visually dissimilar to and distinguishable from the at least one protection clothing piece in terms of color with respect to at least those regions of the at least one protection clothing piece that are contiguous to the at least one opening device.

16. The textile protection clothing unit as claimed in claim 1, wherein the at least one splinter-protection planar textile material or element comprises or is composed of at least one knitted or crocheted textile.

17. The textile protection clothing unit as claimed in claim 1, wherein the at least one splinter-protection planar textile material or element comprises or is composed of at least one knitted or crocheted textile, wherein the knitted or crocheted textile comprises a multiplicity of loops, on the one hand, and a multiplicity of binding elements with at least one binding element being different from said loops, on the other hand, wherein the at least one binding element being different from said loops is selected from the group consisting of loop straps, floats, wefts, inlays and filler yarns.

18. The textile protection clothing unit as claimed in claim 1, wherein the protection clothing unit comprises the at least one splinter-protection planar textile material or element providing a splinter and ballistic protection rating $V_{50}$, as determined according to the NATO standard of STANAG 2920, in the range of from 175 m/s to 795 m/s.

19. The textile protection clothing unit as claimed in claim 1, wherein the protection clothing unit and the at least one protection clothing piece provides a splinter and ballistic protection rating $V_{50}$, as determined according to the NATO standard of STANAG 2920, in the range of from 175 m/s to 795 m/s.

20. The textile protection clothing unit as claimed in claim 1, wherein the protection clothing unit comprises at least one further textile planar material or element, wherein the further textile planar material or element, conjointly with the at least one splinter protection planar textile material or element, configures a single-layer basic area of the protection clothing unit.

21. A textile protection clothing unit providing a ballistic protection function including splinter protection and fragment protection in relation to splinters and fragments which are caused by explosion, and wherein the protection clothing unit is configured in such a manner that the protection clothing unit, under an influence of an explosion or under a ballistic effect, while being hit by primary splinters or primary fragments, does not release or configure any secondary splinters or secondary fragments or does not comprise any components or component parts which release or configure secondary splinters or secondary fragments;

wherein the protection clothing unit comprises or is composed of at least one textile protection clothing piece having a protection function in relation to splinters or fragments that are caused by explosion, wherein the at least one protection clothing piece is configured in such a manner that the at least one protection clothing piece, under an influence of an explosion or under a ballistic effect, while being hit by primary splinters or primary fragments, does not release or configure any secondary splinters or secondary fragments across an entire area of the at least one protection clothing piece or does not comprise, across the entire area of the at least one protection clothing piece, any components or component parts which release or configure secondary splinters or secondary fragments;

wherein the at least one protection clothing piece comprises at least one opening device for at least partial opening of the at least one protection clothing piece, wherein the at least one opening device does not comprise any components or component parts which release or configure secondary splinters or secondary fragments and wherein the at least one opening device is configured such as to be optically or visually dissimilar to and distinguishable from the at least one protection clothing piece, wherein the at least one textile protection clothing piece and the at least one opening device do not have any components or component parts selected from metal or wood or hard plastics material or glass or ceramics, wherein the at least one opening device comprises at least one first opening means and at least one second opening means, wherein the at least one first opening means and the at least one second opening means interact for providing a closure or connection state of the at least one opening device, wherein the at least one first opening means and the at least one second opening means each comprise a multiplicity of connection and receptacle elements for receiving and guiding at least one closure and opening element, wherein the connection and receptacle elements are each configured in a form of hollow elements and wherein the connection and receptacle elements are selected from a group of tubular segments including sleeves, eyelets, and loop bands, and wherein the connection and receptacle elements each are composed of at least one material configured so as to be flexible or flexural, wherein said material of the connection and receptacle elements is selected from a group of soft plastics materials, rubber, natural rubbers, silicones and combinations thereof, and wherein the at least one closure and opening element is configured so as to connect the at least one first opening means to the at least one second opening means and is composed of a material configured so as to be flexible or flexural, wherein the material of the at least one closure and opening element is selected from a group of soft plastics materials, rubber, natural rubbers, silicones, textile materials and combinations thereof and wherein the at least one closure and opening element is selected from the group consisting of a thread, a yarn, a rope, and a cord;

wherein, in a closed state of the at least one opening device, the connection and receptacle elements of the at least one first opening means are, by means of the at least one closure and opening element, interconnected to, or unified with the connection and receptacle elements of the at least one second opening means in an alternating manner to form a continuous tubular structure.

22. A textile protection clothing unit providing a ballistic protection function including splinter protection and fragment protection in relation to splinters and fragments which are caused by explosion, wherein the protection clothing unit is configured as at least one of upper wear and underwear, wherein the protection clothing unit is composed of at least one textile protection clothing piece having a protection function in relation to splinters or fragments that are caused by explosion, and wherein the protection clothing unit is configured in such a manner that the protection clothing unit, under an influence of an explosion or under a ballistic effect, while being hit by primary splinters or primary fragments, does not release or configure any secondary splinters or secondary fragments or does not comprise any components or component parts which release or configure secondary splinters or secondary fragments;

wherein the at least one protection clothing piece is configured in such a manner that the at least one protection clothing piece, under an influence of an explosion or under a ballistic effect, while being hit by primary splinters or primary fragments, does not release or configure any secondary splinters or secondary fragments at least in portions or regions of the at least one protection clothing piece or does not comprise any components or component parts which release or configure secondary splinters or secondary fragments;

wherein the at least one protection clothing piece comprises at least one opening device for at least partial opening of the at least one protection clothing piece, wherein the at least one opening device does not comprise any components or component parts which release or configure secondary splinters or secondary fragments and wherein the at least one opening device is configured such as to be optically or visually dissimilar to and distinguishable from the at least one protection clothing piece, wherein the at least one textile protection clothing piece and the at least one opening device do not have any components or component parts selected from metal or wood or hard plastics material or glass or ceramics, wherein the at least one opening device comprises at least one first opening means and at least one second opening means, wherein the at least one first opening means and the at least one second opening means interact for providing a closure or connection state of the at least one opening device, wherein the at least one first opening means and the at least one second opening means each comprise a multiplicity of connection and receptacle elements for receiving and guiding at least one closure and opening element, wherein the connection and receptacle elements are each configured in a form of hollow elements and wherein the connection and receptacle elements are selected from a group of tubular segments including sleeves, eyelets, and loop bands, and wherein the connection and receptacle elements each are composed of at least one material configured so as to be flexible and resilient, wherein said material of the connection and receptacle elements is selected from a group of soft plastics materials, rubber, natural rubbers, silicones and combinations thereof, and wherein the at least one closure and opening element is configured so as to connect the at least one first opening means to the at least one second opening means and is composed of a material configured so as to be flexible or flexural, wherein the material of the at least one closure and opening element is selected from a group of soft plastics materials, rubber, natural rubbers, silicones, textile materials and combinations thereof and wherein the at least one closure and opening element is selected from the group consisting of a thread, a yarn, a rope, and a cord;

wherein, in a closed state of the at least one opening device, the connection and receptacle elements of the at least one first opening means are, by means of the at least one closure and opening element, interconnected to or unified with the connection and receptacle elements of the at least one second opening means in an alternating manner to substantially enclose the at least one closure and opening element; and wherein the at least one protection clothing piece comprises at least one splinter-protection planar textile material or element comprising or being composed of at least one polyethylene having an ultra-high molecular weight (UHMW-PE).

* * * * *